US007261221B2

(12) United States Patent
Awbrey et al.

(10) Patent No.: US 7,261,221 B2
(45) Date of Patent: Aug. 28, 2007

(54) INVERTED DISPENSING SYSTEM AND APPARATUS

(75) Inventors: Jerry R. Awbrey, Winder, GA (US); Michael D. Brown, Bethlehem, GA (US)

(73) Assignee: Innovation and Design, Inc., Bethlehem, GA (US)

( * ) Notice: Subject to any disclaimer, the term of this patent is extended or adjusted under 35 U.S.C. 154(b) by 130 days.

(21) Appl. No.: 10/742,606

(22) Filed: Dec. 19, 2003

(65) Prior Publication Data

US 2004/0206776 A1 Oct. 21, 2004

Related U.S. Application Data

(60) Provisional application No. 60/463,628, filed on Apr. 16, 2003.

(51) Int. Cl.
*B67D 5/06* (2006.01)

(52) U.S. Cl. ..... 222/181.3; 222/215

(58) Field of Classification Search ..... 222/105, 222/107, 212, 215, 490, 494, 556, 180, 181.2, 222/181.3; 206/806; 215/395, 399; 220/481–483, 220/751; 248/690, 692
See application file for complete search history.

(56) References Cited

U.S. PATENT DOCUMENTS 3,078,016 A * 2/1963 Judy ..... 222/181.2
3,078,017 A * 2/1963 Waskonig et al. ..... 222/181.3
3,623,641 A * 11/1971 Hansen et al. ..... 222/181.3
4,085,867 A * 4/1978 Heller ..... 222/181.3
4,163,509 A * 8/1979 Amneus ..... 222/95
4,166,553 A * 9/1979 Fraterrigo ..... 222/181.2
4,203,567 A * 5/1980 Featherstone ..... 248/108
4,412,624 A 11/1983 Tamaka
4,470,521 A * 9/1984 Scammell ..... 222/107
4,723,671 A 2/1988 Mears
4,728,006 A 3/1988 Drobish et al.
4,763,382 A 8/1988 Sumerau
4,793,517 A 12/1988 Washut
4,905,873 A * 3/1990 Loesel et al. ..... 222/181.2
4,969,580 A 11/1990 Mikhail (Continued)

OTHER PUBLICATIONS

Product Information Sheet—Coppertone Suncare Products, Spectra 3 http://www.coppertone.com/spectra3.aspx.

(Continued)

*Primary Examiner*—Philippe Derakshani
(74) *Attorney, Agent, or Firm*—J. Bennett Mullinax, LLC

(57) ABSTRACT

A disposable inverted dispensing system for distributing a fluid for use in a shower is disclosed. The dispensing system includes a removable hooking device that is attachable to a surface which is exposable to moist conditions. A hook integral to the removable hooking device extends from the hooking device on a side opposite the surface when the hooking device is attached to the surface. A deformable container for containing the fluid has an upper portion and a lower portion. The upper portion defines a through-hole through the container, and the lower portion forms a container mouth through which the fluid is flowable. A dispensing valve and/or a cap is disposed over the mouth of the container for controlling the flow of the fluid. The container is positionable on the hooking device with the hook extending through the through-hole formed by the upper portion of the container so that the container hangs down from the hooking device.

39 Claims, 8 Drawing Sheets

U.S. PATENT DOCUMENTS

| | | | | | |
|---|---|---|---|---|---|
| 5,014,880 | A | * | 5/1991 | Loesel et al. | 222/181.2 |
| 5,067,680 | A | * | 11/1991 | Miller | 222/181.2 |
| 5,307,955 | A | * | 5/1994 | Viegas | 222/107 |
| 5,427,343 | A | | 6/1995 | Ferris | |
| 5,435,513 | A | | 7/1995 | Davis | |
| 5,439,193 | A | | 8/1995 | Coulter et al. | |
| 5,454,516 | A | | 10/1995 | Smyrl | |
| 5,499,748 | A | * | 3/1996 | Iaia et al. | 222/180 |
| D371,479 | S | * | 7/1996 | Hirst | D6/542 |
| 5,664,753 | A | | 9/1997 | Takei | |
| 5,673,884 | A | * | 10/1997 | Yemini | 248/205.5 |
| 5,702,009 | A | | 12/1997 | Ouellet et al. | |
| 5,704,495 | A | | 1/1998 | Bale et al. | |
| 5,749,490 | A | | 5/1998 | Keicher | |
| 5,749,497 | A | * | 5/1998 | Davis | 222/181.2 |
| 5,819,984 | A | * | 10/1998 | Krueger | 222/181.2 |
| 5,975,372 | A | * | 11/1999 | Heyn | 222/181.3 |
| 6,065,649 | A | * | 5/2000 | Scoggins | 222/181.2 |
| 6,202,901 | B1 | | 3/2001 | Gerber et al. | |
| 6,234,357 | B1 | * | 5/2001 | Lewis | 222/175 |
| 6,283,334 | B1 | * | 9/2001 | Mahaffey et al. | 222/175 |
| 6,308,923 | B1 | | 10/2001 | Howard | |
| 6,345,723 | B1 | | 2/2002 | Blake et al. | |
| 6,427,874 | B2 | | 8/2002 | Brown et al. | |
| 6,530,504 | B2 | * | 3/2003 | Socier | 222/212 |
| 6,575,335 | B2 | | 6/2003 | Lewis et al. | |
| D480,955 | S | | 10/2003 | Perlowski et al. | |
| 6,808,090 | B2 | * | 10/2004 | Pedersen | 222/181.3 |
| 2003/0178443 | A1 | * | 9/2003 | Pedersen | 222/181.3 |

OTHER PUBLICATIONS

Product Information Sheet—Avon, Light & Lush Moisturizing Shower Gel with Hydroseal http://shop.avon.com/avonshop.

Product Information Sheet—Clearasil, Acne Fighting Body Wash http://www.clearasil.us/products.

International Search Report and Written Opinion of the International Searching Authority; Aug. 12, 2005.

* cited by examiner

INVERTED DISPENSING SYSTEM AND APPARATUS

CLAIM OF PRIORITY AND CROSS REFERENCE TO RELATED APPLICATIONS

This application claims the benefit of U.S. Provisional Patent Application entitled "Shower Dispenser Bottle," filed Apr. 16, 2003, and having Ser. No. 60/463,628 and U.S. Design application entitled "Suction Cup Mounted Shower Dispenser," filed Oct. 27, 2003, and having a Ser. No. 29/192,586.

BACKGROUND OF THE INVENTION

This subject matter concerns a dispensing system for a fluid in general, and more particularly a disposable inverted dispensing system for dispensing shampoo or other liquid materials (such as soap or conditioner, or gel or lotion of any type) for use in a shower.

The manufacture and sale of hair care and personal hygiene products constitutes an expansive market. As can be seen in almost any household, shampoo, conditioners, liquid soaps, and other materials represent a large portion of this market. Conventionally, such products are sold in plastic containers which stand upright with a capping device on top through which the fluid, for example, shampoo, conditioner, liquid soap, or other lotions is dispensed. The designs of such containers create several different drawbacks and problems from storage to dispensing. Such plastic containers litter the bathroom shower area of many households creating unsightly clutter. Often, the containers are not readily accessible within the shower area which can lead to the spilling of the container's content. Such clutter, inaccessibility and possible spills can create safety hazards within the shower area, as well as create waste and other disadvantages.

The upright containers also create a dispensing issue due to the configuration of the container in which it is contained and/or the potentially viscous nature of the content being dispensed. The nature of these containers requires the user to perform several steps to dispense the contents of the container. The user typically must pick up the container, invert it and usually squeeze it by applying the user's own pressure on multiple sides of the container to extract the fluid of the container. Further, with the dispensing opening of these containers on the upper end of the container when it is in a stored position, the fluid settles in the bottom of the container prior to use. The more the fluid in the container is used, the longer the distance the fluid must travel with less momentum due to the decrease in the mass of the fluid after each use, and the greater the effort and time required to dispense what fluid remains in the container. Often, the user must shake or otherwise manipulate the container to obtain sufficient fluid from the container.

Other devices and containers have tried to address these problems of the upright containers with varying degrees of success, but all have their own distinct disadvantages. Hanger mechanisms can be attached to upright containers or can hold the upright containers to allow them to be hung upside down on the shower rod or the neck of the showerhead, thereby removing the containers from the floor of the shower and allowing the contents of the containers to settle at the dispensing zone of the container. However, these hanger mechanisms require the user to spend time attaching the hanger mechanism to the container. Some require a hanger to be screwed into the container, creating the opportunity for inadvertent discharge of the fluid. Others require the container to be inserted into a holding mechanism which is then tightened around the container. After the content is dispensed from the container, the holding mechanism is then loosened and the container has to be removed from the hanger mechanism requiring more time consumption.

Also, such hanger mechanisms impede the shower curtain when hung on the shower curtain rod or crowd the neck of the showerhead which has become an often-used location to otherwise hang personal care items. Further, the user still must grab the container on multiple sides and squeeze to dispense the contents.

Permanent soap dispensers as seen in many public restrooms may tend to alleviate certain aspects of clutter, but the user has the burden of filling the dispenser on a periodic basis. For these permanent dispensers, containers of shampoo, conditioner, liquid soap, or other liquid material must be purchased in a store and then the contents of these containers must be transferred into the permanent dispensers. The transfer of such fluid is time consuming and, if care is not taken, creates an opportunity to spill (i.e., waste) the fluid, which in many instances may be rather expensive, particularly for "premium" products such as designer hair care formulas. Further, permanent soap dispensers are affixed to a shower wall in such a manner that, upon removal, lasting marks are left on the wall where the dispenser had been attached.

A need still exists for a dispensing system for shampoos, conditioners, liquid soaps or other consumable personal care fluids that does not add to the clutter around a shower area, is easily accessible in the shower, and decreases the possibility of spillage. A need also exists for the dispensing system to be easily assembled and disassembled to allow for the quick set up (i.e. installation) and disposal of the dispensing system, while still permitting the user to dispense the shampoo, conditioner, soap, or other liquid in a well facilitated fashion without having to shake or manipulate any part of the dispensing system.

SUMMARY OF THE INVENTION

The present subject matter recognizes and addresses the above-briefly discussed drawbacks, and others, of the prior art dispensing systems. Accordingly, one broad aspect of the present subject matter is to provide an improved dispensing system. A further present general object is to provide a dispensing system which can be attached to a shower wall. A still further present more specific object would be to provide a disposable, inverted dispensing system which would allow easy access to and distribution of the fluid in the container, while minimizing the risk of spillage. Additional aspects and advantages of the present subject matter will be set forth in part in the following description, or may be obvious from the description, or may be learned through practice of the present subject matter.

Also, it should be appreciated that modifications and variations to the specifically illustrated and discussed features hereof may be practiced in various embodiments and uses of this subject matter without departing from the spirit and scope of the subject matter. Such variations may include, but are not limited to, substitutions of equivalent features and means for those shown or discussed, and the reversal of various constructions, or the like. Still further, it is to be understood that different embodiments, as well as different presently presented preferred embodiments, of the present subject matter may include various combinations of presently disclosed features, or their equivalents (including combinations of features or steps or configurations thereof not expressly shown or stated).

One such exemplary embodiment of the present subject matter relates to a disposable dispensing system for dispersing a fluid for use in a shower. The dispensing system comprises a hooking device that is attachable to a surface in the shower. A hook integral to the hooking device is extendable from the hooking device on a side thereof opposite the shower surface. The system also includes a resilient deformable container that holds the fluid. The container has an upper portion and a lower portion with the upper portion defining a through-hole therethrough and the lower portion forming a container mouth through which the fluid can flow. The dispensing system also includes a cap placed over the container mouth. The cap has an aperture that can be operably aligned with the container mouth for dispensing the fluid.

When such a present exemplary dispensing system is properly installed, the container can be positioned on the hooking device with the hook extending through the through-hole formed by the upper portion of the container so that the container hangs down from the hooking device and the container rests against the surface thereby allowing a user to apply pressure to a side of the container opposite the shower surface, in order to advantageously dispense the fluid within the container.

In another present exemplary embodiment, the cap can have a dispensing valve which covers the aperture that operably aligns with the container mouth. The dispensing valve holds the fluid in the container until sufficient pressure is applied to the container which in turn applies enough pressure on the dispensing valve to allow the fluid to discharge from the dispensing system. This dispensing valve may be in the form of a silicon membrane forming an exit slit or slits in the membrane portion which covers the aperture. In a resting position, these slits are in a closed position which does not allow the fluid within the container to escape. Once the fluid applies enough pressure on the membrane, the slits are forced opened to allow a flow of the fluid out of the container. This occurs once the user applies enough pressure to the container, so the arrangement advantageously allows the user to very simply and accurately control the fluid flow.

In other embodiments in which the fluid in the container has a high enough viscosity, the dispensing valve may be an aperture having a small enough cross section to prevent the fluid from coming out of the aperture until sufficient pressure is applied. The cap may be any variety of caps including disk closure, flip-top closure, push-pull closure, or spout closure, etc. In such embodiments as well as with embodiments employing a silicon membrane or embodiments without a dispensing valve, the cap may have a lid which covers the aperture of the cap through which the fluid is dispersed. The lid may be integral to the cap, for example, such as a disk closure cap or a flip-top, or may be removable like a screw-on lid or a snap on lid. In some embodiments, the lid may be folded and snapped on the back of the cap or container to keep the cap in an opened position. In other embodiments, a dispensing valve without a cap is used, such as a reed valve. Further, as is the case of a disk closure, the cap may act as or comprise a dispensing valve.

In other exemplary embodiments, the hooking device may be a suction cup device from which the hook extends. The suction cup device should create enough suction with the wall to allow the container to hang from the hook until the user is ready to remove the dispensing system. In such an exemplary embodiment, the suction cup device may be a lever action suction cup with the lever comprising the hook from which the container will ultimately hang. Such a lever action suction cup creates a suction force with a surface which is strong enough to hold a container full of a fluid such as shampoo, conditioner, soap, or other liquid for an extended period. At the same time, the lever serves a second function of being the hook from which the container hangs.

The resilient deformable container in accordance with the present subject matter may take on a variety of shapes as long as the shape allows the user to apply pressure to the side opposite the shower wall (surface of the shower against which the container is hung) to dispense the fluid. In such embodiments, the hooking device and the container should interact with each other in such a manner that the container rests against the shower wall or surface. In a further exemplary embodiment, the resilient deformable container has a front side that faces away from the shower surface and a back side that faces toward the shower surface, and with the back side being more planar than the front side. The back side rests against the shower wall, so as to stabilize the hanging container and better allow the user to apply his own pressure to only the front side of the container to dispense the fluid. Preferably, the container creates this stability by preventing undue rocking or swaying of the container and by minimizing or preventing folding of the container when pressure is applied.

In a further exemplary embodiment, a deformable bag is used to contain the fluid having an upper portion and a lower portion with the upper portion defining a through-hole therethrough and the lower portion forming a bag mouth through which the fluid can flow. As with the resilient deformable container, the upper portion through-hole is in fact completely sealed to the container portion of the bag, such that no fluid escapes the bag-through such through-hole. Instead, the hook or hanging element passes through the bag, not into the bag.

The deformable bag can hang from the hooking device with the hook extending through the through-hole of the deformable bag from which the bag hangs. The deformable bag may have a cap as described above attached thereto. However, a dispensing valve may be directly attached to the bag mouth or may be formed by the bag mouth. Before being hung for use, a cover tip of the bag may have to be cut off or otherwise removed to form the mouth of the bag in some embodiments to which a dispensing valve may be applied or, the bag may be sold directly to the user with a dispensing valve connected directly to the mouth.

Those of ordinary skill in the art will better appreciate the features and aspects of such embodiments, methods, and others, upon review of the remainder of the specification.

BRIEF DESCRIPTION OF THE DRAWINGS

A full and enabling disclosure of the present subject matter, including the best mode thereof, directed to one of ordinary skill in the art, is set forth in the remainder of the specification, which makes reference to the appended Figures, in which.

DETAILED DESCRIPTION

Reference will now be made in detail to the presently preferred embodiments of the present subject matter, one or more examples of which are shown in the Figures. Each example is provided to explain the subject matter, and not as a limitation of the subject matter. In fact, features illustrated or described as part of one embodiment can be used with another embodiment to yield still a further embodiment. It is intended that the present subject matter cover such modifications and variations.

Figure 1:
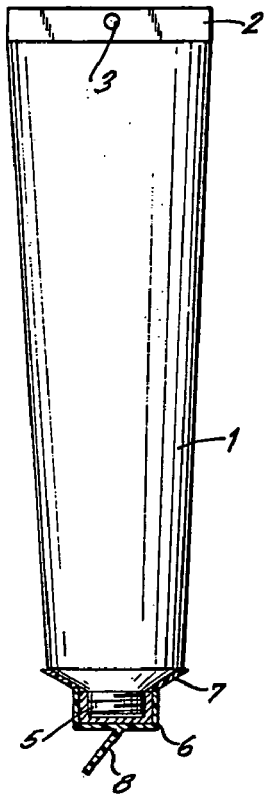
FIG. 1 shows a perspective view of an exemplary embodiment of a dispensing system according to the present subject matter.

FIG. 1 shows an embodiment of a dispensing system 10 having an inverted resilient deformable container 20 and a hooking device 15 used to dispense fluids, especially fluids used in a shower environment, such as shampoos, conditioners, liquid soaps, lotions, or other fluids. The container 20 has an upper portion 27 and a lower portion 29. The upper portion 27 defines a through-hole 21 through the container 20 having through-hole walls 22. Through-hole 21 is formed such that fluid stays within container 20 rather than emerge from (or enter into) through-hole 21. In other words, the through-hole is through the container, collectively, not through a single wall of the container and into its interior. The lower portion 29 of the containers 20 forms a mouth which is covered by a closure cap 25. The closure cap 25 in this embodiment has a lid 23 covering a cap aperture (not seen in this figure) that provides an outlet for the fluid contained in the container 20, thereby allowing the fluid to flow out of the mouth of the container 20 and through the aperture of the cap 25. The lid 23 is removable from the aperture of the cap 25 to permit the flow of the fluid. The inverted positioning of the container 20 (i.e., portion 27 above portion 29 thereof in relation to gravity) relative to the exit (as formed by the mouth of container 20 and the aperture of cap 25) provided for the fluid, keeps the fluid in a position to flow easily out of the container 20 due to the fact that the fluid settles at the lower portion 29 of the container 20 adjacent to where the exit is located.

Figure 2:
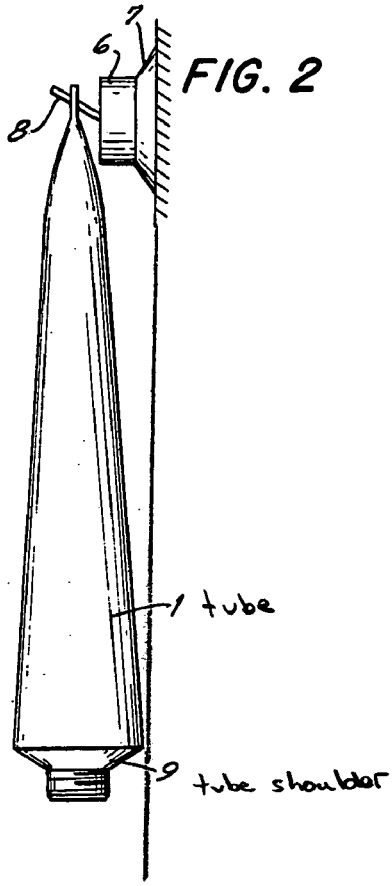
FIG. 2 shows a hooking device as shown in FIG. 1 in an unlocked position with an arrow showing the motion of a lever-arm/hook which attaches the hooking device on a shower surface.

In the embodiment shown, the hooking device 15 is a suction cup device having a suction element 19 which can be attached to such as a shower surface or a wall through application of suction force and, upon removal, leave no ill or lasting effects on the surface or wall. In particular, a lever-arm suction device having a lever-arm 16 can be used. As is shown in FIG. 2, the lever-arm 16 is attached to the suction cup element 19 of the hooking device 15 by a hinge 14 at a central position of the hooking device 15. The lever-arm 16 is used to set the suction cup element 19. The suction cup element 19 is placed against a surface or wall while the lever-arm 16 is in an upward position. With the downward motion V of lever-arm 16 around hinge 14, suction is created between the suction cup element 19 and the surface or wall, thereby causing the hooking device 15 to stick to the surface or wall. In the set position of the hooking device 15 as seen in FIG. 1, lever-arm 16 extends perpendicularly in a locked position, thereby forming a hook 17 in the center of the hooking device 15. In the use of the dispensing system 10, the container 20 hangs from the hook 17 by fitting the through-hole 21 of the container 20 over hook 17.

The hooking device can be attached to a shower surface or wall in multiple ways. As discussed earlier, the hooking device may be attached to the surface through suction cups. However, different types of suction cups other than a lever action suction device may be use. Further, other types of attachment mechanisms can be used, for example, tape, glue or, if necessary, screws. For these reasons, the hook 17 does not have to be a lever-arm 16. Instead, it can be just a plain hook which serves no other function outside of being a hook for receipt of through-hole 21.

The positioning of the hook 17 can also be some place other than just extending 90° from the center of the hooking device. For example, it may be lower on the hooking device and/or may have more of a rounded or curved shape. However, the particular height of the dispensing system in a given embodiment may be suggested by or even regulated by the packaging constraints imposed by the market and manufacturing concerns. All such variations are intended to come within the broader aspects of the present subject matter.

Figure 3:
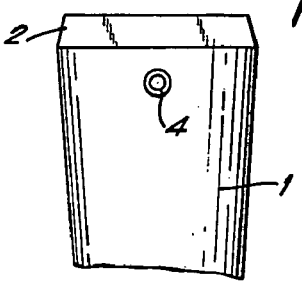
FIGS. 3, 3A, and 3B show a front view, a side view, and a bottom view of the embodiment of a container of an exemplary dispensing system as shown in FIG. 1.
Figure 3:
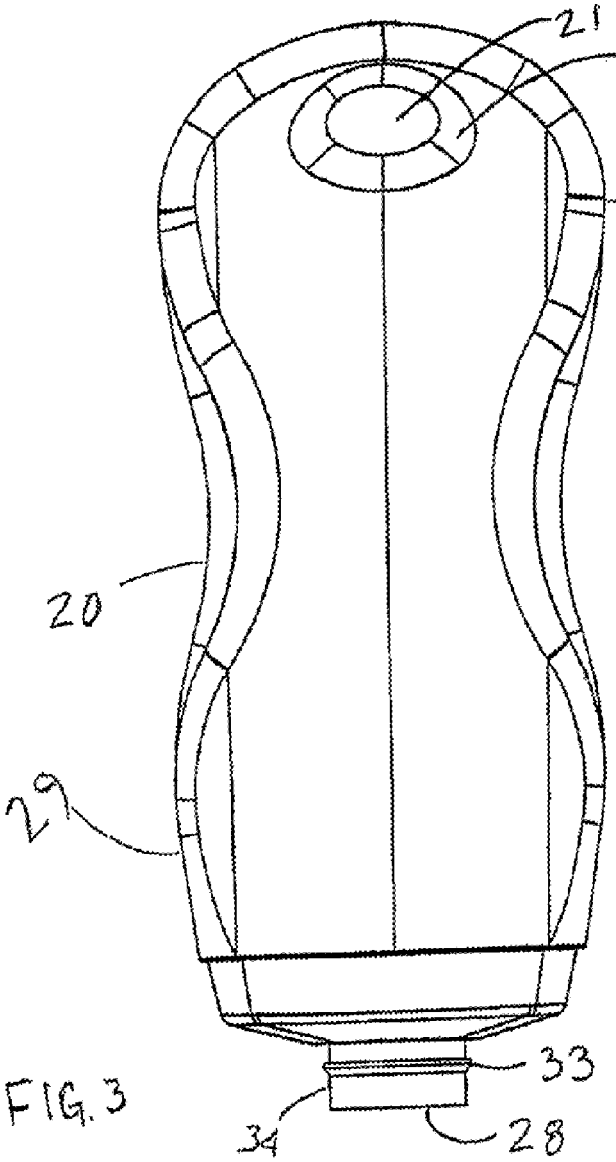
Figure 3A:
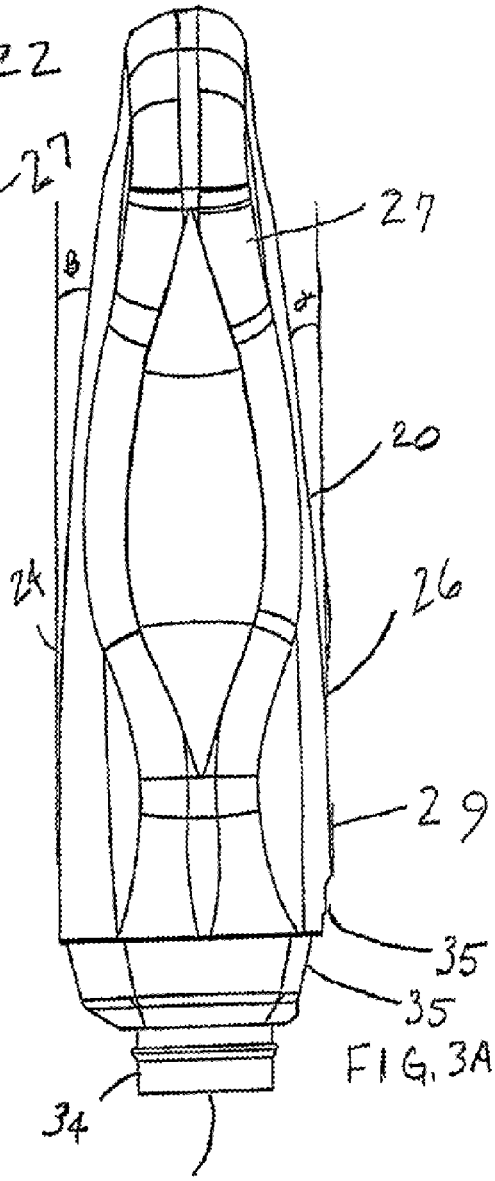
Figure 3B:
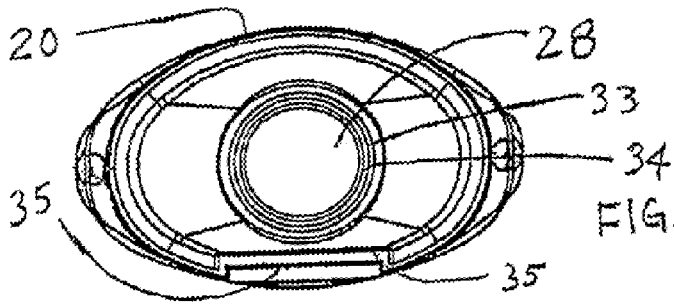
Figure 4:
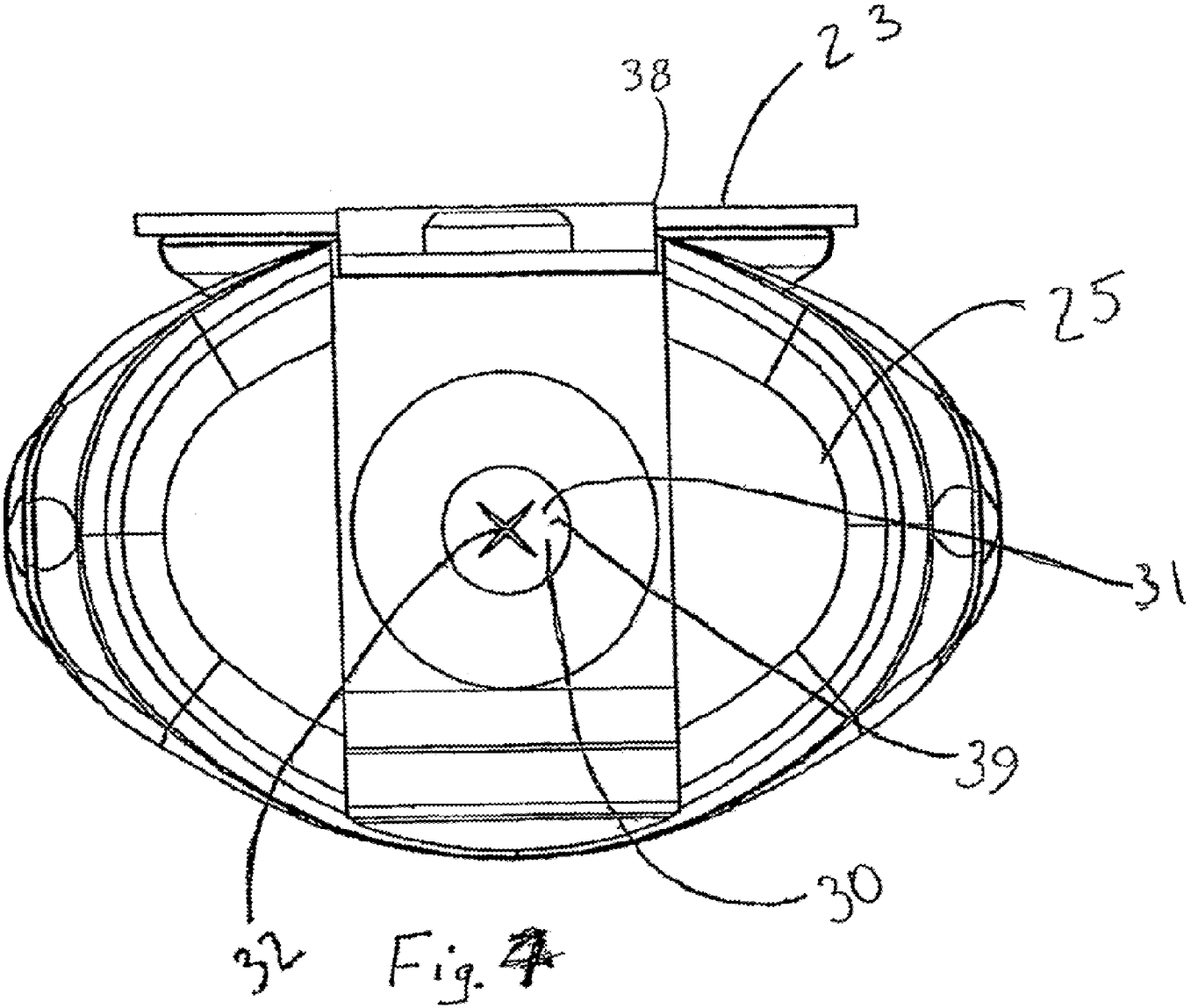
Figure 1:
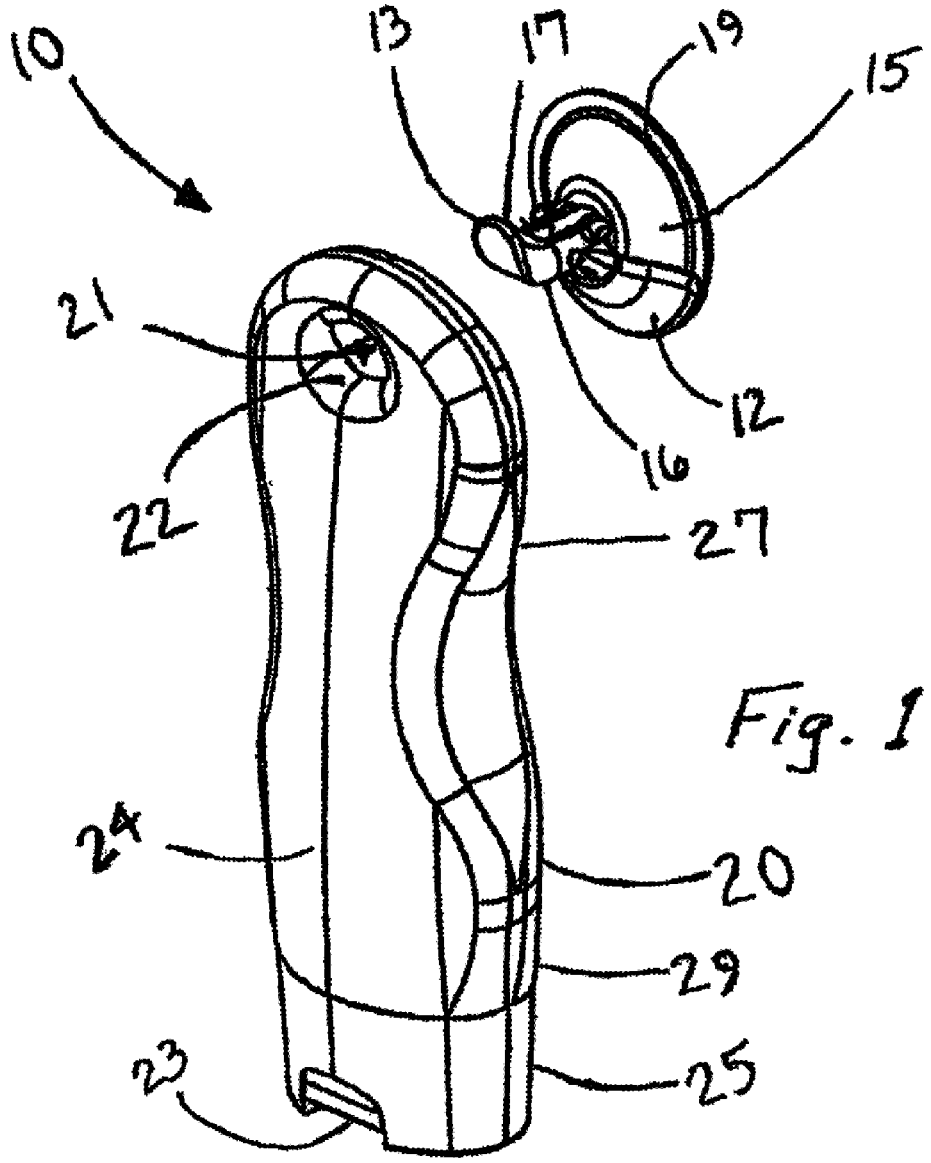
Figure 2:
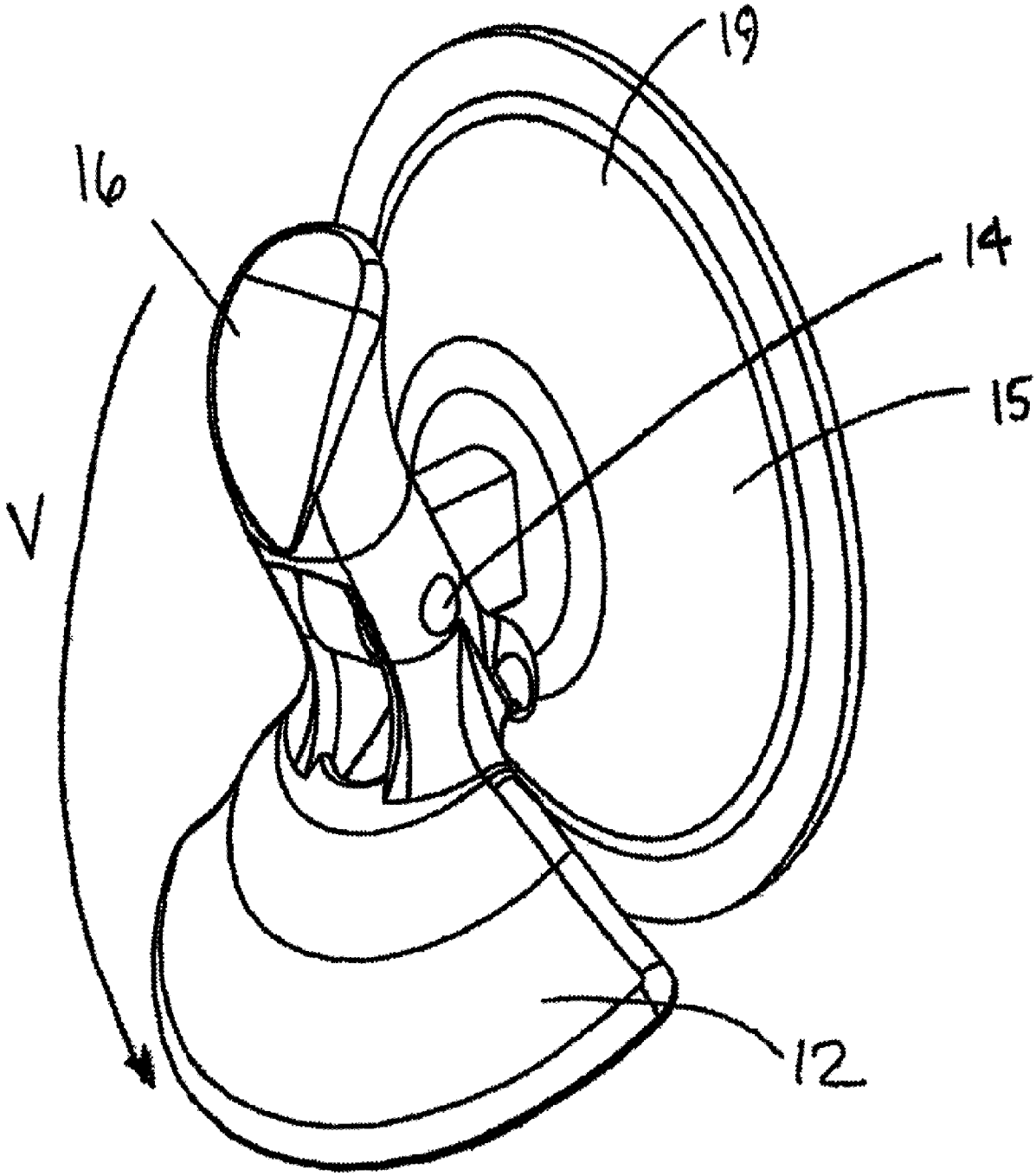
Figure 4:
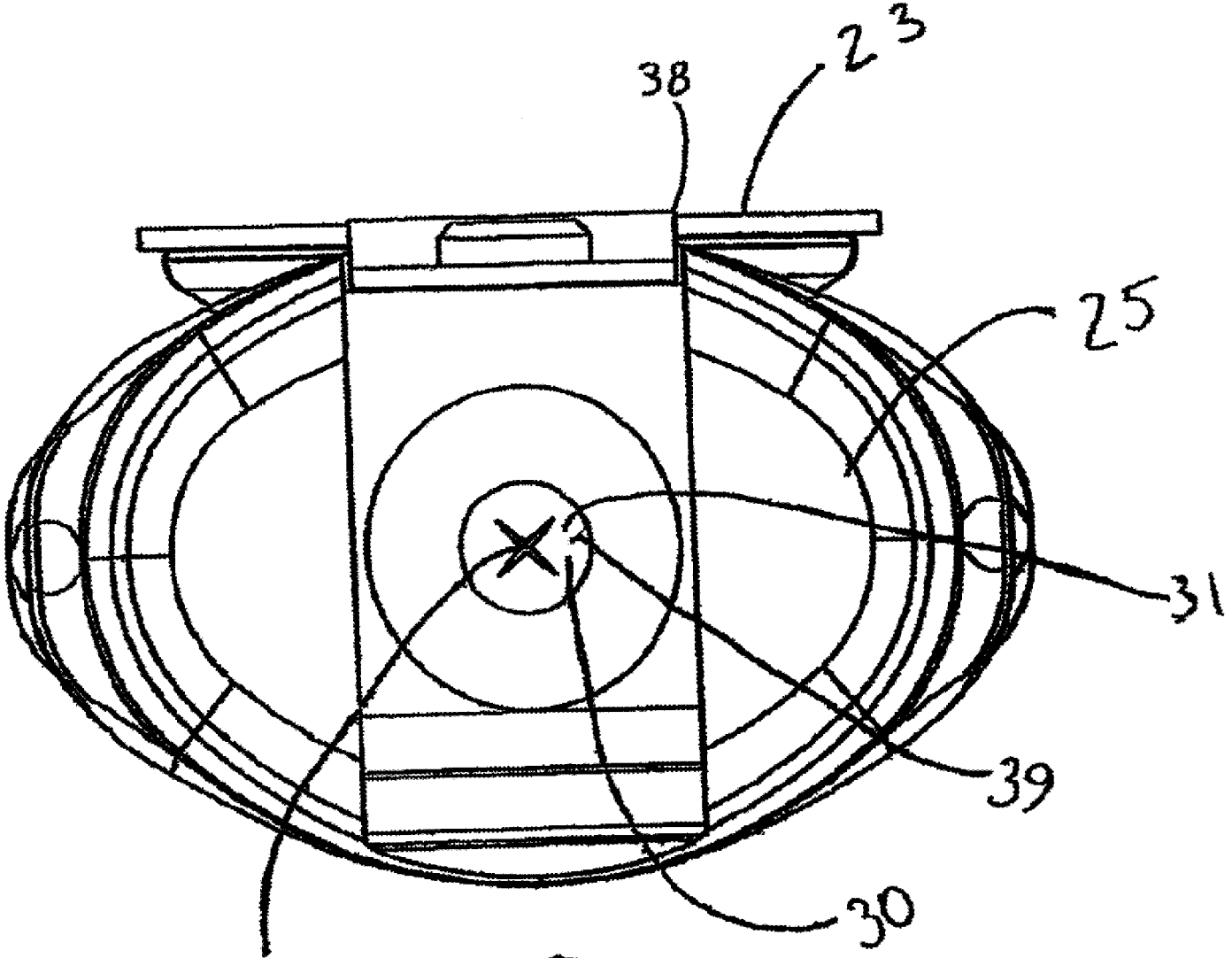
Figure 5:
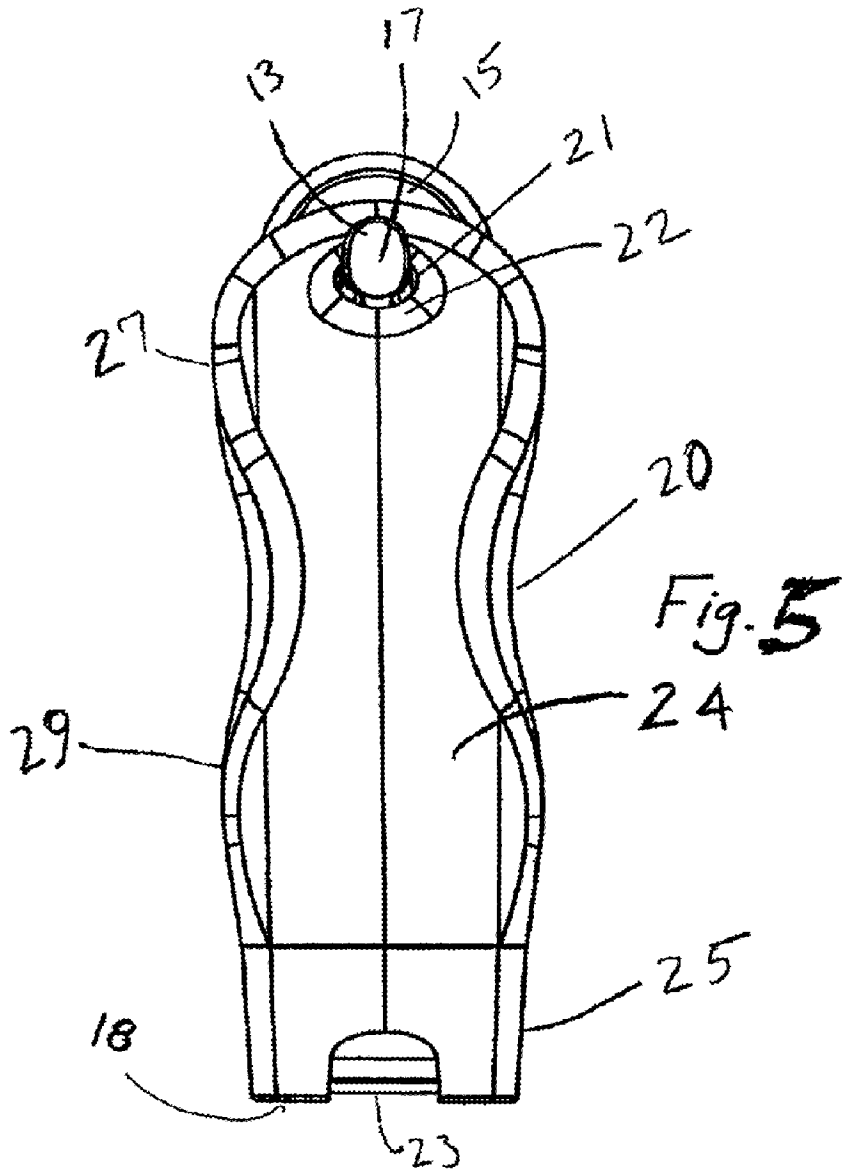
Figure 6:
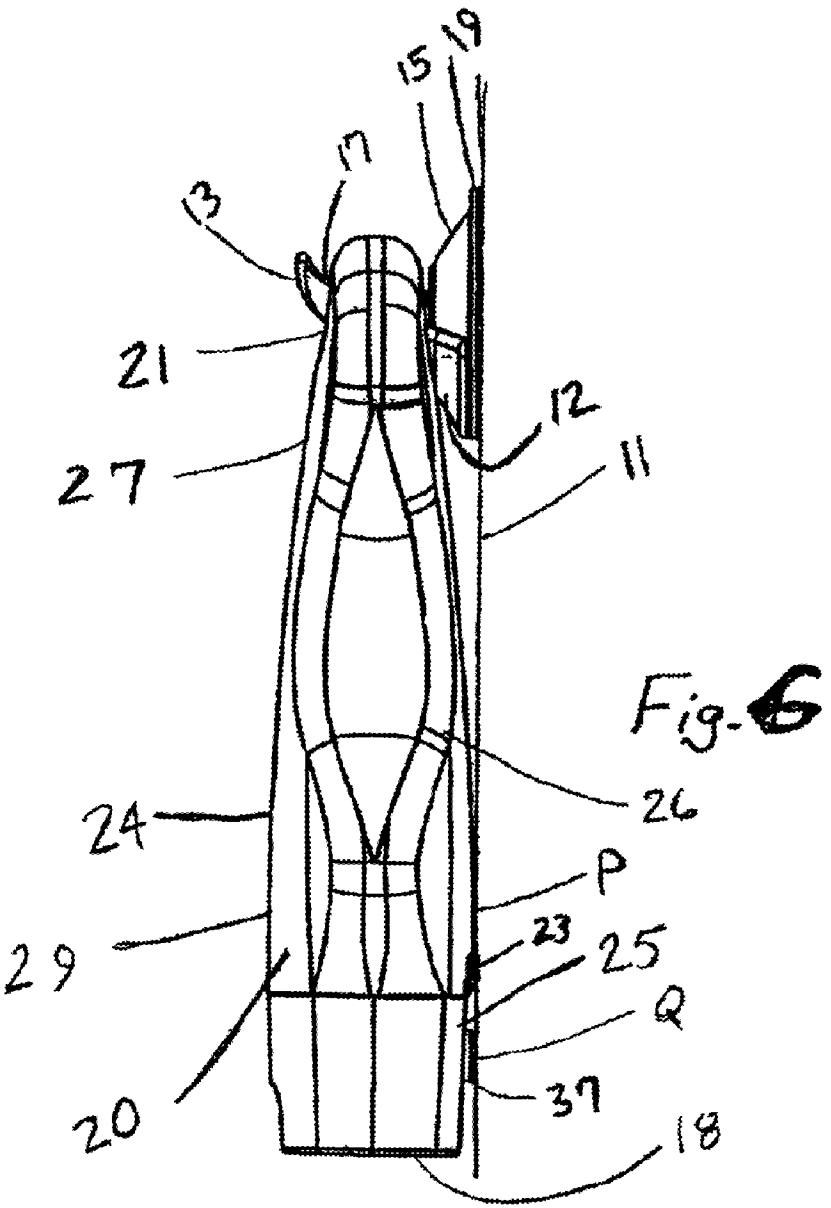
Figure 7:
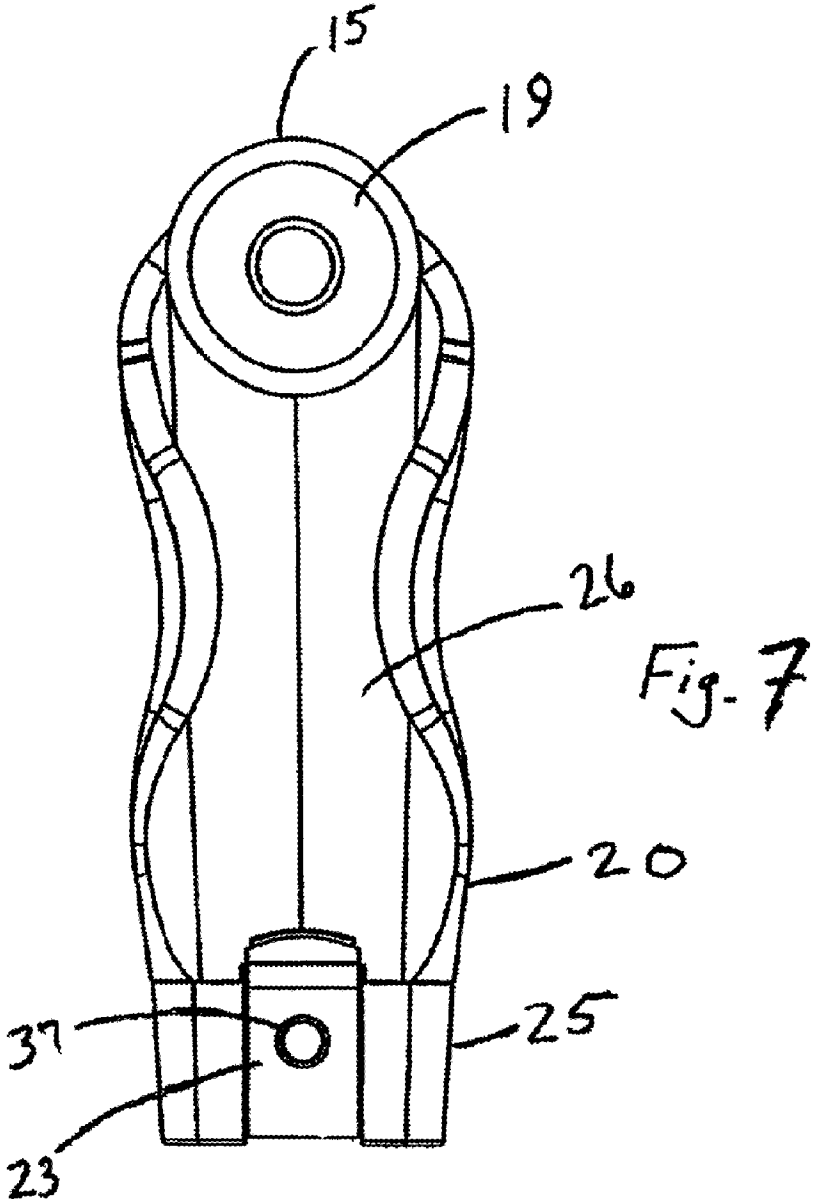
Figure 8:
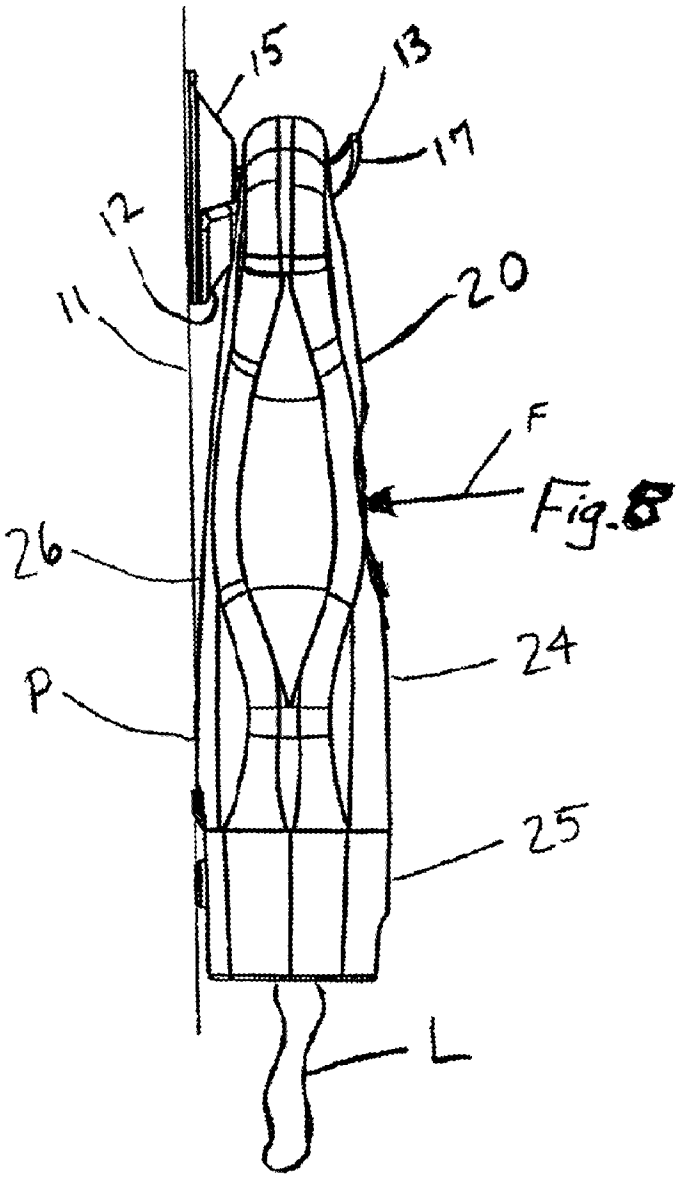
Figure 9:
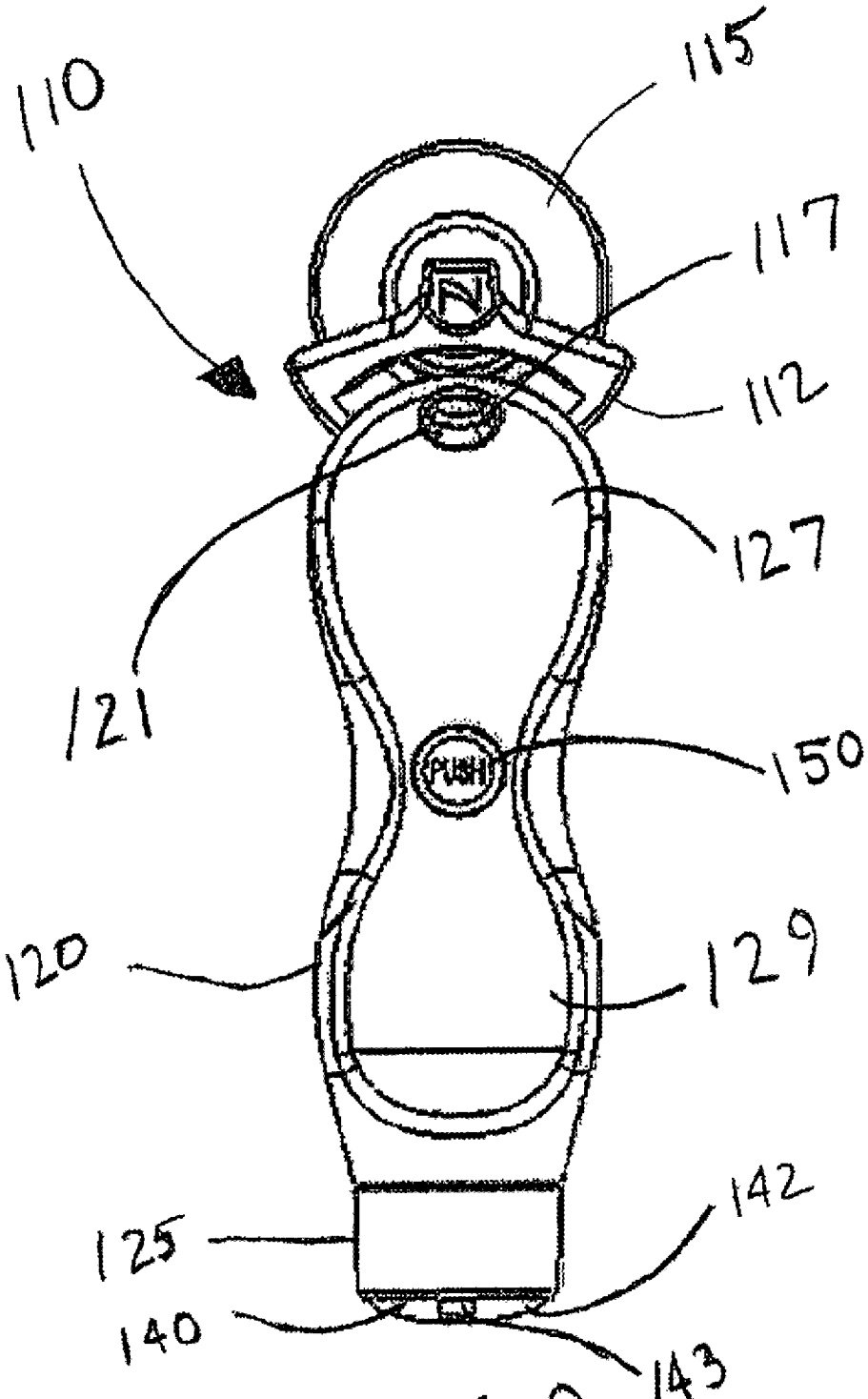
Figure 10:
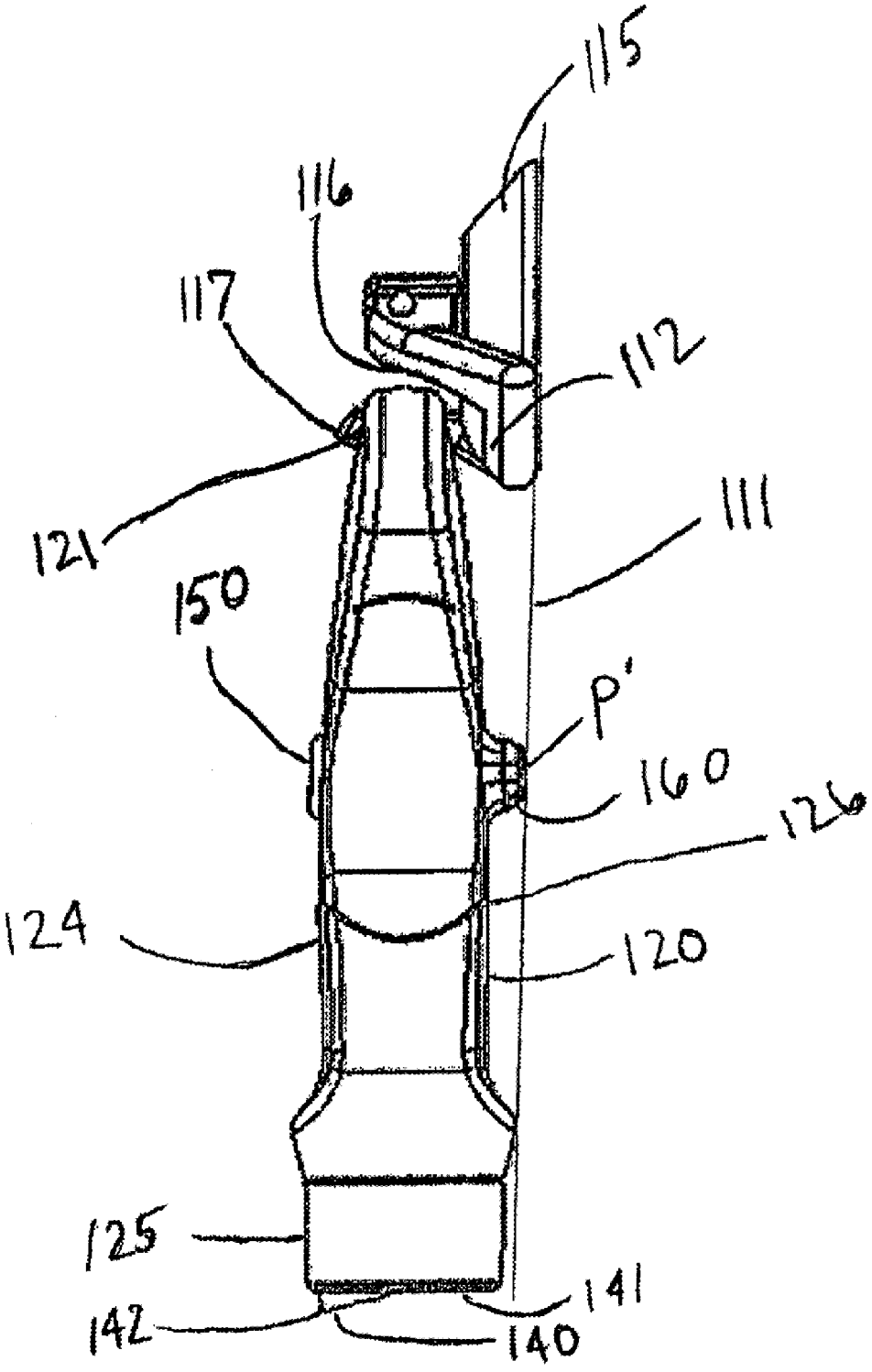
Figure 11:
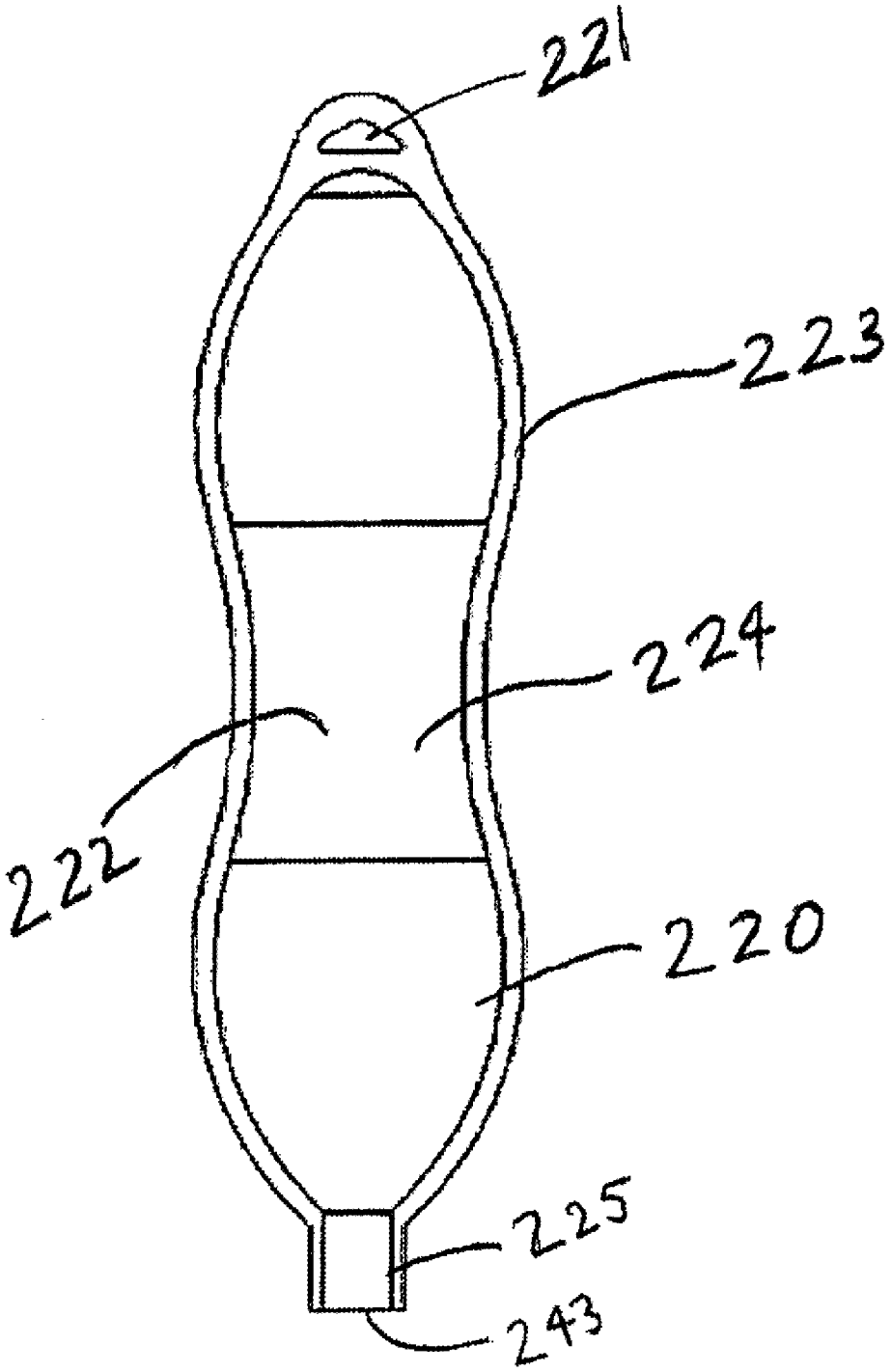

FIGS. 3, 3A and 3B show different views of an embodiment of the resilient deformable container 20. The resilient deformable container 20, preferably in the form of a bottle, can be made of different material preferably a plastic material such as HDPE, PTE, PVC, Polypropylene, etc. The material used preferably should be flexible enough to allow the walls of the container 20 to deform, but preferably also rigid enough to be resilient, thereby permitting the container 20 to substantially return to its original shape. The particular shape of the container 20 is not critical within the context of the present subject matter other than the container 20 should form a through-hole 21 for hanging the container 20 and the shape should permit the container to rest in a stable position against the surface or wall from which it hangs.

As illustrate in such Figures, this exemplary embodiment of the container 20 possesses a circumferential neck 34 at the bottom of the lower portion 29. The neck 34 forms the mouth 28 through which the fluid will flow. In this embodiment, the neck 34 also forms a snap ring 33 to allow a cap 25 (as seen in FIG. 1) to be snapped onto the neck 34 and cover the mouth 28. However, the cap may be attached to the container in any manner, for example, the cap may be screwed on, attached by an adhesive, or melted onto the container 20.

In some embodiments as seen in the side view of FIG. 3A, a front side 24 of the container 20 and a back side 26 of the container 20 converge as they approach the upper portion 27 from the lower portion 29 of the container 20, thereby forming a tapered shape on such two sides of the container 20. This convergence of both the back side 26 and the front side 24 of the container 20 creates taper angles α, β with lines planar to the widest part of the lower portion 29 on both sides, respectively. This taper makes the cross-section of lower portion 27 smaller than the cross-section of the lower portion 29.

The taper serves several purposes including adding draft or increasing the draft angle to the container 20 to increase the ease with which the container 20 may be removed from a mold in which it is formed. The shape of the upper portion 27 and the angle of the taper on either side of the center of the container also adds stability because it puts the center of gravity generally over the center of the cap. Also, the taper of the upper portion of the container aids in the forming of the through-hole 21 by reducing the distance between the front side 24 of the container 20 and the back side 26 of the container 20, thereby allowing the walls 22 of the through-hole 21 to be narrower making it easier to create the through-hole 21 and thus easier to manufacture the container 20.

Figure 6:
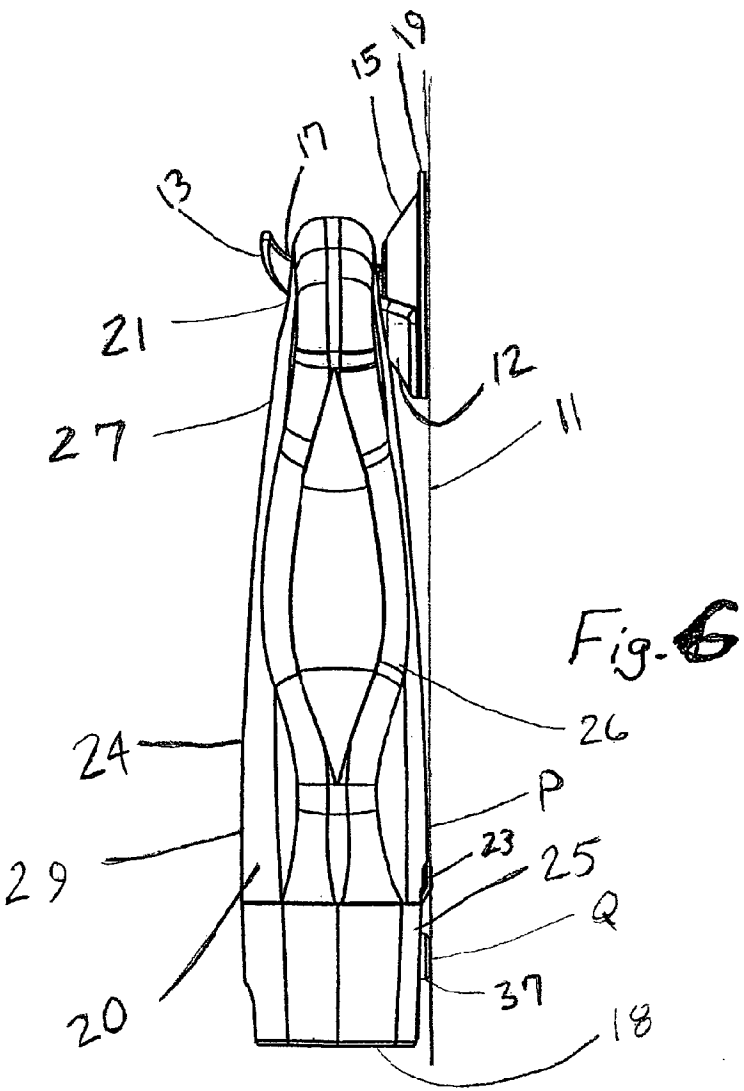
FIG. 6 shows a side view of the exemplary dispensing system as shown in FIG. 1 hanging from a shower surface according to the intended use of the present subject matter.
Figure 7:
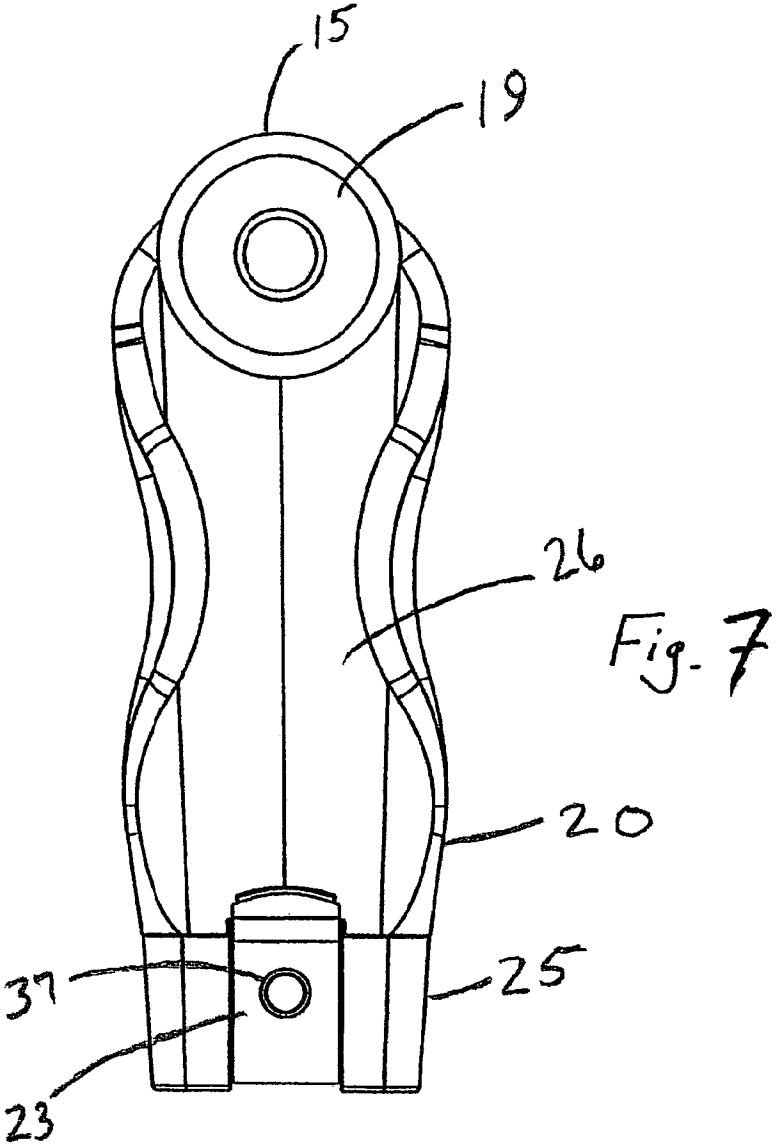
FIG. 7 shows a back view of the exemplary dispensing system as shown in FIG. 1 according to the present subject matter.

In the illustrated embodiment, the back side 26 defines indentions 35 (as seen in FIGS. 3A and 3B) in which a lid 23 for a cap 25 (as seen in FIGS. 1, 6 and 7) can fit. These indentions 35 allow the lid 23 which is integral to the cap to attach to the container 20 leaving the cap in an open position, while at the same time not letting the lid 23 get in the way of allowing the container 20 to rest in a stable position against the surface or wall. A snap or some other attachment mechanism may be used to hold the lid in the indentions 35.

Figure 4:
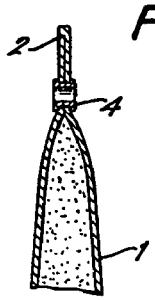
FIG. 4 shows a bottom view of the exemplary dispensing system shown in FIG. 1, in particular, a cap and a dispensing membrane.

FIG. 4 shows a view from the bottom of the dispensing system, in particular, an oval cap 25. The lid 23 of the cap 25 integral thereto is folded along a hinge 38 and preferably attachable to the back side 26 of the container as referenced above. The lid 23 opens the cap 25 to expose an aperture 39 in the cap 25 which is covered by a dispensing valve 30. The aperture 39 is aligned with the mouth 28 (as seen in FIG. 3B), so that the fluid contained within the container flows out of the mouth and through the aperture 39 of the cap 25 and the dispensing valve 30.

A dispensing valve may be any type of valve which inhibits the flow of fluid in such a manner that the user controls when the fluid in the container flows out of the container. The dispensing valve 30, in this embodiment a diaphragm membrane 31 made of silicon, prevents the fluid contained in the container from flowing out of the container until sufficient pressure is applied to the container. The diaphragm membrane 31 has a slit 32 which rests in a closed position until sufficient pressure is applied by the fluid to cause the slit 32 to separate, thereby allowing the fluid to exit the container 20. The slit 32 is a cross slit, however, a single slit or other patterns of slits or openings which prevent the flow of fluid in a resting position can be employed.

Figure 5:
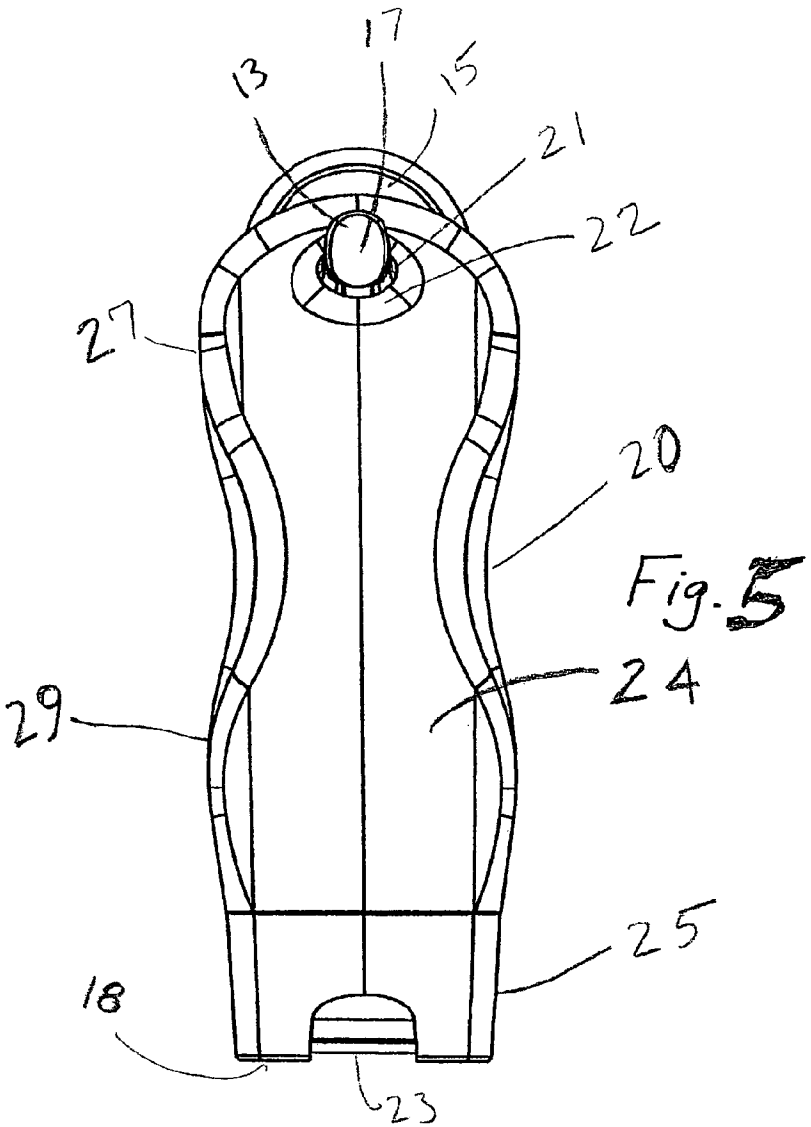
FIG. 5 shows a front view of the exemplary dispensing system according to the present subject matter as shown in FIG. 1.

In another embodiment not shown in which the fluid has a higher viscosity, the cap can form a hole with a small cross-section to serve as a dispensing valve. The cap, acting as a dispensing valve, may also employ other methods to prevent a free flow of fluid out of the container such as a disk closure cap, a lever, flip-top, push-pull, or spout closure caps, etc. Further, the cap may be any cross-sectional shape such as an oval, a rectangle or a circle. In a similar manner, the end 18 of the cap 25 (as seen in FIGS. 5 and 6) can be rounded, flat or some other shape at its end. However, it is advantageous for the end 18 of the cap 25 to be flat for containers that have a tapered shape to give the container 20 a surface that permits the container to stand in a vertical position on a corresponding flat surface. With such a design, the container can be set on a shelf of a store or may be removed from the hook of the dispensing system and placed on the floor of a shower or on a shelf within the shower, if need be, while keeping the fluid in the lower portion 29 of the container 20 for easy dispensing.

In the front and side views of the dispensing system of FIGS. 5 and 6, exemplary views are illustrated of how the dispensing system looks hanging from a surface, or wall, 11. The hooking device 15 once attached to the surface or wall 11 allows the hook 17 with a hook lip 13 to extend out away from the surface or wall 11 with the hook lip 13 pointing in an upward direction. When container 20 is hung on the hook 17, the hook lip 13 extends out of the through-hole 21 and curves upward above the through-hole wall 22 of the through-hole 21 to secure the container 20 on the hook 17.

The container 20 hangs from hook 17 in a defined inverted position per the present arrangement so that the fluid in the container 20 rests in the lower portion 29 of the container 20 and the container 20 rests in a stable position against the surface or wall 11 in a first contact area P.

The lid 23 of the cap 25 which is in a closed position can be folded back to leave the cap 25 in an open position as can be seen in FIGS. 6 and 7. The lid 23 of the cap 25 has a raised lip 37 which enters the aperture 39 formed by the cap 25 and can contact the dispensing valve 30. When the lid 23 is in an opened position and is attached to the back of the container, the raised lip 37 can extend outward to add another contact point Q between the dispensing system and the surface, or wall, 11, thereby adding to the stability of the hanging container.

As can be seen in FIG. 5, hooking device 15 in this embodiment is barely exposed above the upper portion 27 of the container 20 when the dispensing system is attached to a surface or a wall. Such position of the hook and container serves several purposes. One reason is to hide the hooking device to make the dispensing system more attractive to a user. Another reason as mentioned earlier pertains to marketing constraints as far as the space provided in a store to sell such a product. A further reason is to aid in the providing of support to the container 20 to ensure that the container 20 rests properly and in a stable position against the surface, or wall, 11.

As can be seen in the embodiment shown in FIGS. 1, 2 and 6, a skirt 12 on the hook 17 can aid in the stability of the dispensing system 10. The skirt 12 is raised from the hooking device 15, thereby protruding further out from the suction cup element 19 of the hooking device 15. The skirt 12 nests in the recessed upper portion 27 formed by the taper of the container 20 and nestled against the through-hole walls 22 to allow the container to rest against the surface 11 as it hangs from hook 17. The skirt 12 in combination with the center of gravity of the container and the tapered shape of the container aligns the container 20 with the surface or wall 11 so that the back side 26 of the container 20 rests against the shower surface or wall 11 in the first contact area P, when the container 20 is on the hook 17.

In some embodiments, the back side 26 of the container 20 may be more planar than the front side, thereby preventing the container from rocking on the hook 17, thereby making dispensing easier. In other embodiments, the container may be shaped to allow the front side 24 and the back side 26 to be interchangeable. In some embodiments, it can be advantageous for the side facing the surface or wall 11 to contact the surface or wall 11 as much as possible, thereby creating a larger first contact area P. In further embodiments, the tapered shape is not employed. The larger the first contact area P, the more stable the container is during dispensing. Such embodiments lessen the need for a functional skirt 12.

Figure 8:
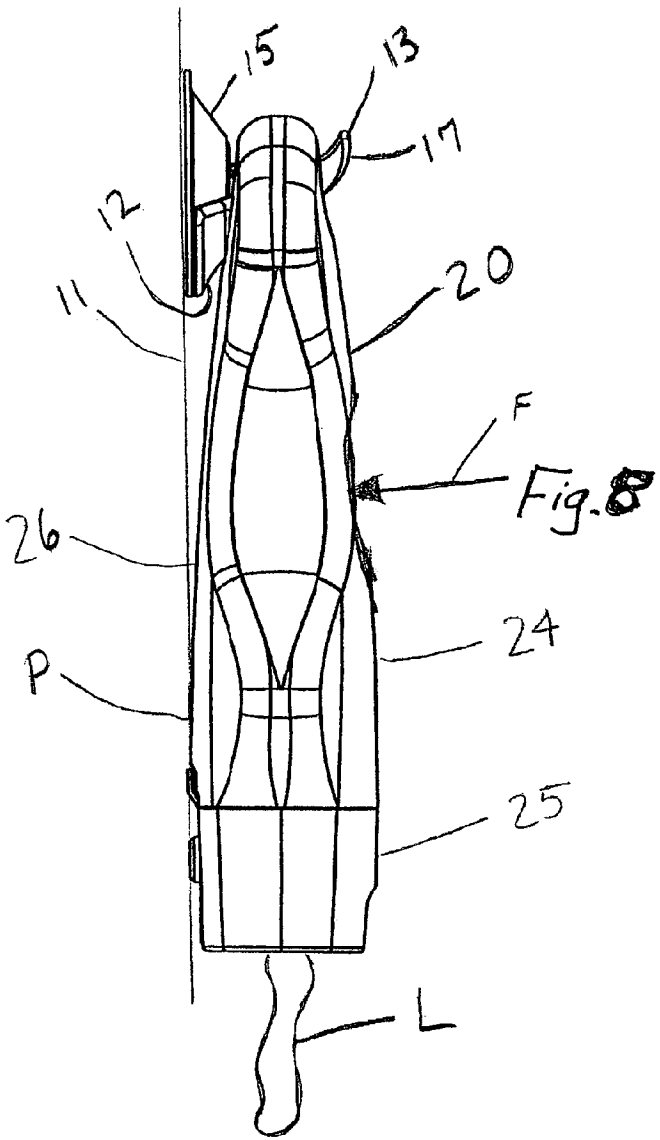
FIG. 8 shows a schematic of a side view of the exemplary dispensing system, as shown in FIG. 1, dispensing fluid according to the present subject matter.

FIG. 8 demonstrates the dispensing system in use. A force F is applied to the front side 24 of the resilient deformable container 20. This force F, which represents a user pushing against the front side 24, presses the back side 26 of the container 20 against the shower surface or wall 11 in the first contact area P, thereby causing the container 20 to deform and create a positive pressure within the interior of the container 20. This internal pressure pushes the fluid L which is settled in the lower portion 29 of the container 20 against the dispensing valve causing the dispensing valve (within cap 25) to dispense the fluid L from the container 20.

In most embodiments, it is preferable to have the first contact area P to be located at or below the point where the force F is applied creating optimal stability of the dispensing system during the dispensation of the fluid L to increase the ease of such dispensation. This positioning of the first contact area P is preferable due to the fact that the hooking device 15 with the skirt 12 contacting against the tapered back side 26 of the upper portion 27 of the container 20 form a second contact area. The first contact area P in the lower portion 29 of the container 20 and the second contact area between the container 20 and the hooking device 15 create stabilizing points. When the force F is applied intermittent to these two stabilizing points, the force is distributed between the two points.

The folding of the container when pressure is applied also detracts from the stability of the dispensing system. Depending on the rigidity of the container, if the contact points are too distant from each other, the container will fold where pressure is applied. The first contact area P should be positioned to prevent folding of the container when pressure is applied to the container to dispense the fluid. This positioning can be accomplished in several ways. In some embodiments, the first contact area P is positioned close enough to the second contact area to greatly minimize the effect of folding. In other embodiments, the first contact area P is large enough to prevent or greatly minimize folding of the container. In still further embodiments, the first contact area P can be strategically placed in an area which aligns with the portion of the container which is pushed to dispense the fluid, thereby preventing undue folding of the container. Further, it should be well understood that the container, cap, and hooking device can create multiple contact areas with a surface or wall. Such multiple contact areas are covered by the present subject matter.

Once the force F is removed, the resiliency of resilient deformable container 20 allows the container 20 to substantially resume the shape it possessed before the force F was applied. The container 20 regains an internal equilibrium with the dispensing valve, thereby not allowing the fluid to exit the container 20 or the cap 25 until a sufficient internal pressure is again created within the container by applying a force to the outside of the container. Once another sufficient external force is applied to the container 20, the internal pressure increases, disturbing the internal equilibrium and in turn causing the fluid to flow from the dispensing valve.

Figure 9:
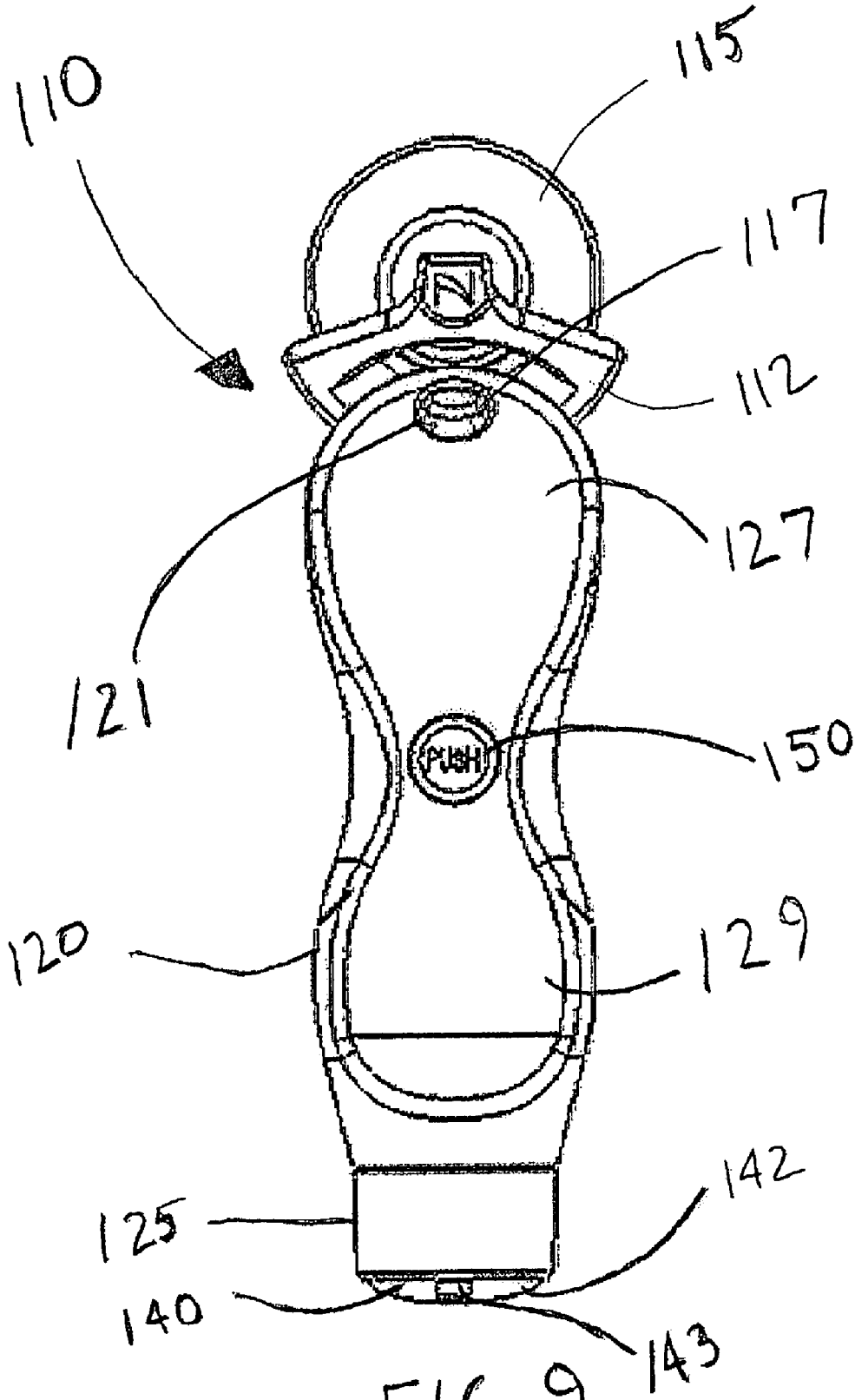
FIG. 9 shows a front view of another exemplary embodiment of a dispensing system according to the present subject matter.
Figure 10:
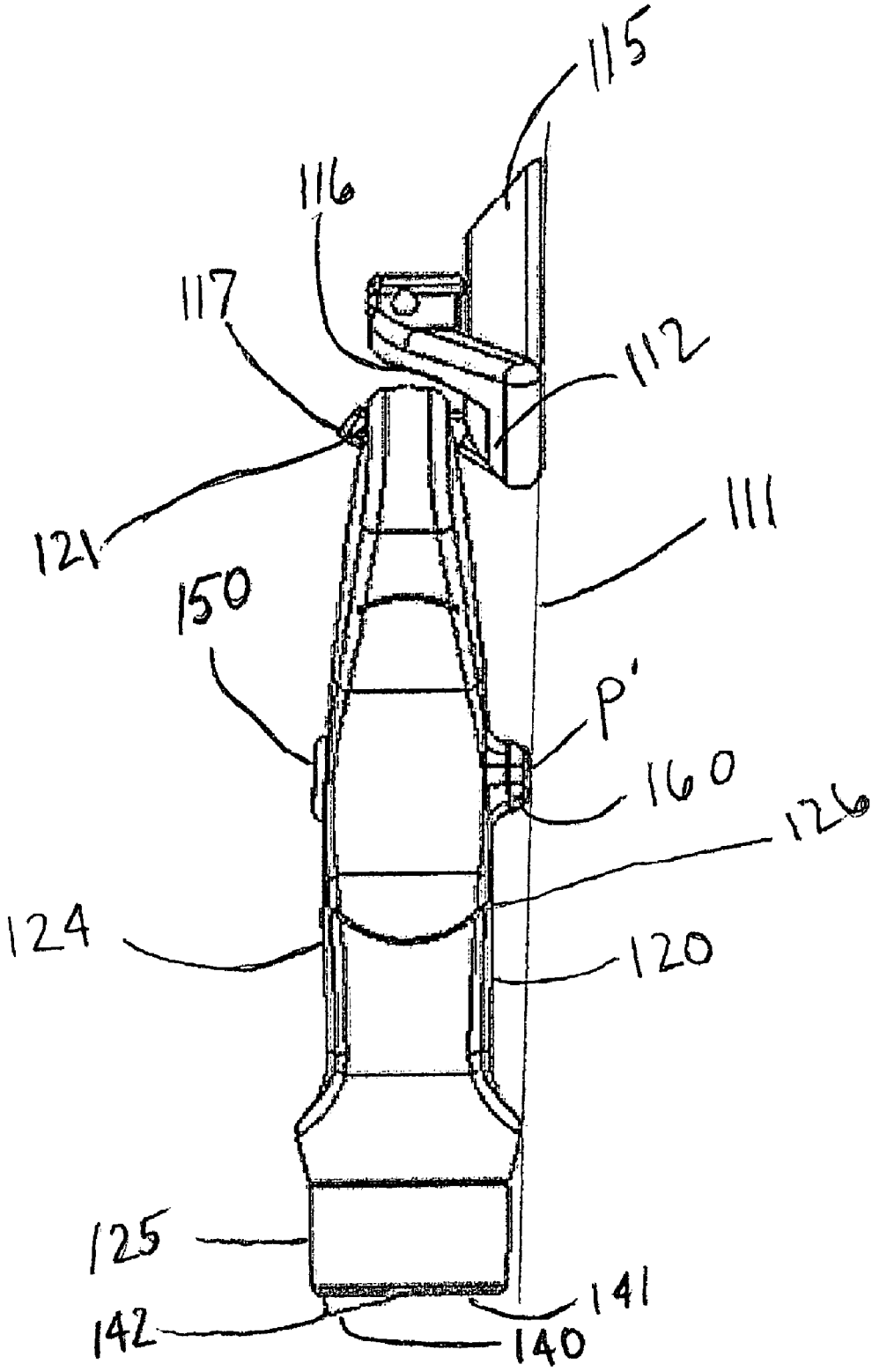
FIG. 10 shows a side view of the exemplary embodiment of a dispensing system as shown in FIG. 9 according to the present subject matter.

A further embodiment of a dispensing system of the present subject matter is shown in FIGS. 9 and 10. A dispensing system 110 is shown having a hooking device 115 and an inverted resilient deformable container 120 which can be hung from a hook 117 integral to the hooking device 115. The container 120 forms a through-hole 121 in an upper portion 127 of the container 120. The hooking device 115 attaches to a shower surface or wall 111, and the container 120 can then be hung by the through-hole 121 from the hook 117. Attached to a lower portion 129 of the container 120 is a disk closure cap 125.

Container 120 possesses a front side 124 which faces away from the surface 111 and a back side 126 which faces toward the shower surface 111. The container 120 defines a knob 160 on the back side 126 of the container 120. Once the hooking device 115 is attached to the surface 111 and container 120 is hung from the hook 117, the knob 160 should contact the surface 111 at a contact area P', thereby allowing the container 120 to rest against the surface 111. Knobs, like knob 160, can be installed on or be an integral part of containers that have shapes that do not allow such containers to rest in a stable position against a surface or wall without aid from the knob. By adding knobs or similar abutments, a container which does not rest in a stable position can now rest in a stable position even when pressure is applied. Such knobs or similar abutments are particularly useful in preventing folding of the container when pressure is applied.

On such an embodiment, as well as on other embodiments, it may be beneficial to have an indicator 150 to indicate where the optimum location on the front side 124 of the container 120 for the user to apply pressure to distribute the fluid. The indicator 150 may be a raised portion of the container 120. Also, the indicator may be in the form of a sticker labeled "push" or may be a combination of both a raised portion of the container 120 and a label as shown in FIGS. 9 and 10.

The closure cap 125 can be snapped on or screwed onto the container 120. In the embodiment shown, the cap 125 has a circular cross-section, however, the cross-section may be elliptical, rectangular, triangular, etc. The closure cap 125 is a disk closure cap having a disk shaped dispensing unit 140, which individual unit 140 is known in the art, and otherwise in this embodiment combined with the present subject matter. The disk shaped dispensing unit 140 has a central connection which creates a fulcrum allowing two halves 141, 142 of the disk shape dispensing unit 140 to be pivotal around this central connection. The cap 125 is opened by pressing down on the disk shaped dispensing unit 140 on a first half 141 which causes a second half 142 of the disk shaped dispensing unit 140 to extend outward from the cap 125. When the second half 142 is extending outward, a dispensing aperture 143 is exposed through which the fluid contained in the dispensing system 110 can flow. It is advantageous for the disk closure cap 125 to be a dispensing valve that requires a pressure to be applied within the container 120 to force the fluid to flow out of the dispensing aperture 143 when the closure cap 125 is in an open position. As stated above, other types of caps such as screw-ons, lever, flip-top, push-pull, or spout closure caps, etc., may be used. Different types of dispensing valves may also be employed like a silicon membrane, a small cross-sectional hole valve, etc.

The hooking device 115 as with other embodiments can be attached to the surface 111 in various manners including using suction, glue, tape, etc. In some embodiments, more permanent attachment devices may be used such as screws and nails. However, it is still desirable in most embodiments to use an attachment mechanism which does not leave permanent marks on the surface or wall. In the embodiment shown, the hooking device 115 employs a suction cup element 119 having a lever-arm 116 attached thereto to create a lever action suction with the surface 111 as described above. In this embodiment, hook 117 does not extend perpendicularly from a central portion of the hooking device 115, but rather extends from an outer perimeter point of the hooking device 115. The hooking device 115 may or may not possess a skirt 112. Further, the container 120 does not need to contact the skirt 112 when it is hanging from hook 117 in its resting position against surface 111 as is shown in FIG. 10, since the user pushes the container right over the stabilizing point of contact area P'. This may also be true where there may be another contact area between the container or cap and the wall.

Figure 11:
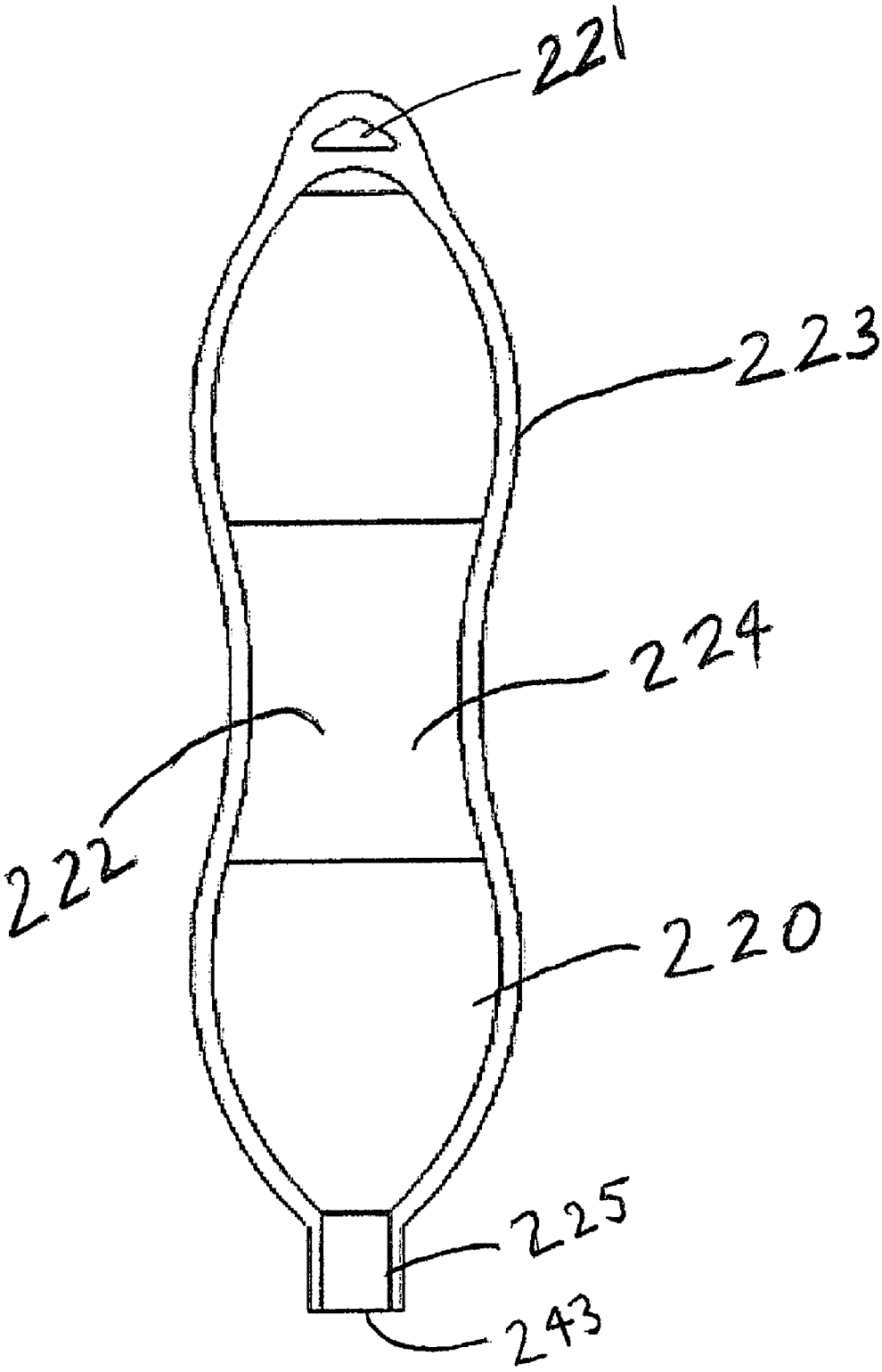
FIG. 11 shows a perspective view of a further exemplary embodiment according to the present subject matter, and involving a deformable container.
Figure 1:
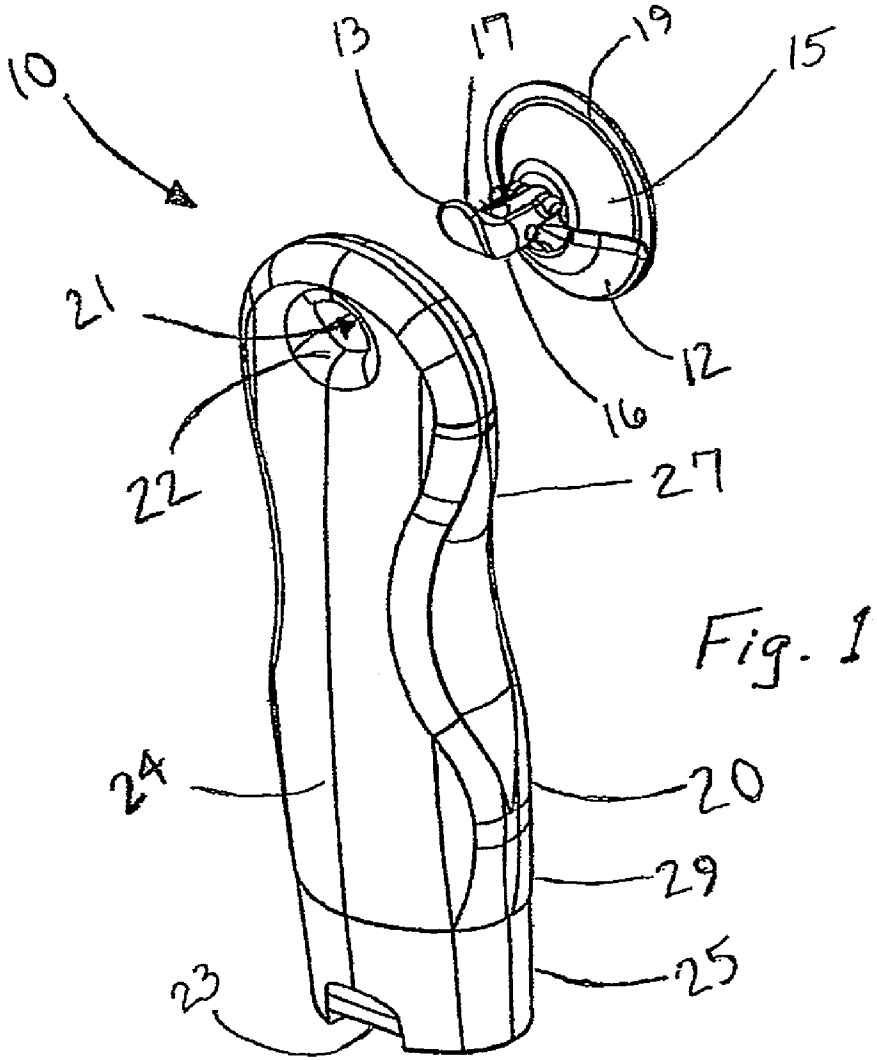
Figure 2:
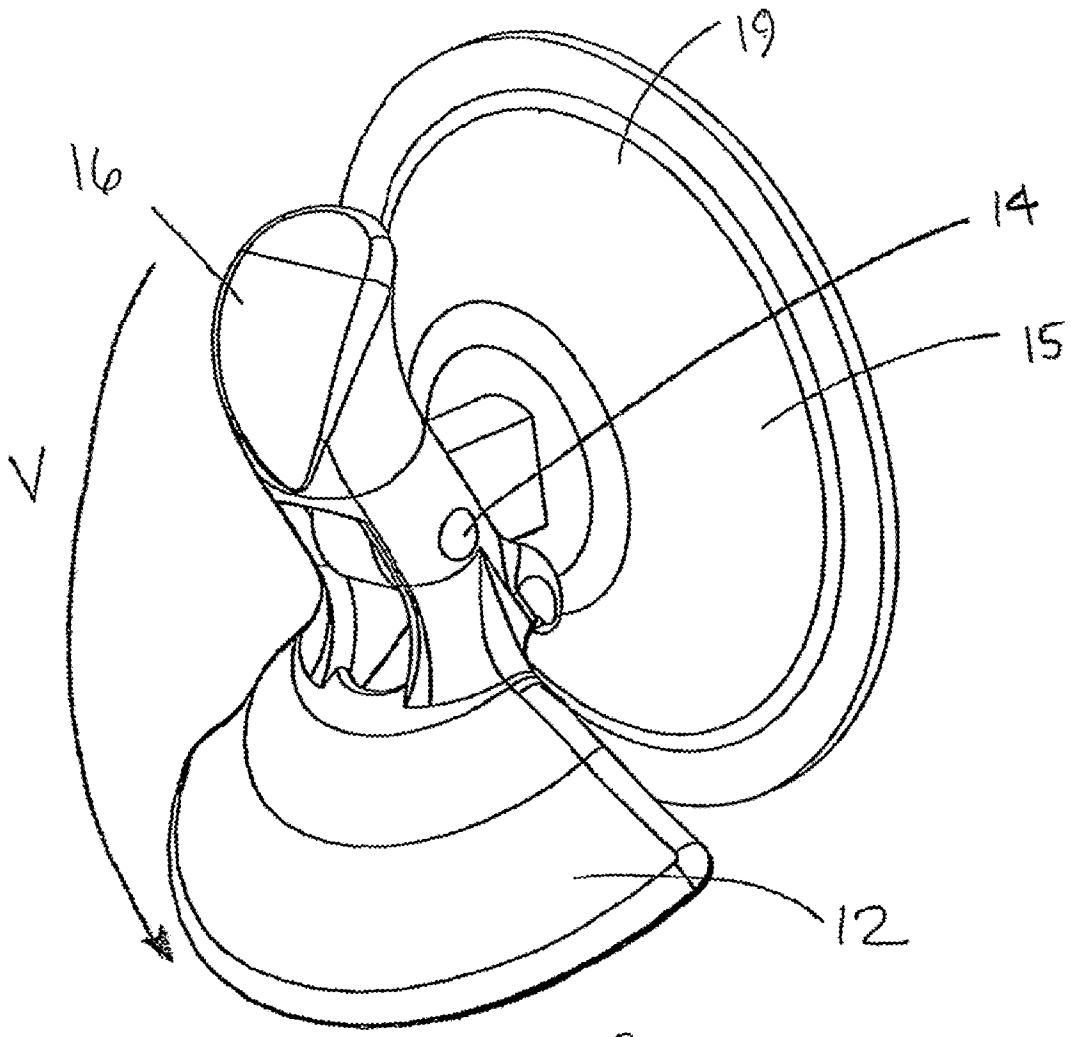

FIG. 11 shows a different embodiment of the present subject matter, making use of a container in the form of a deformable bag 220. The deformable bag 220 defines a through-hole 221 at one end of the bag and a dispensing valve 225 at an opposing end. The bag 220 may be hung on a hooking device as described above so that the dispensing valve 225 faces in a downward position permitting the contents of the bag 220 to rest in the end of the bag 220 from which the dispensing valve 225 extends. To dispense the fluid, the bag 220 should be squeezed, thereby applying pressure on the dispensing valve and allowing the fluid to flow therefrom.

The bag 220 can be made of different material, but preferably a plastic material such as HDPE, PTE, PVC, Polypropylene, etc. is used. Also, the bag may be constructed of a foil material. The bag 220 can be made of a single section of material or multiple sections. Such sections or sections can by attached together mechanically, thermally, or chemically to form the bag. In the embodiment shown, the bag 220 is formed by two sections, a front section 224 and back section (not shown), which are fused together along a seam 223 forming a body 222 which holds the fluid contained inside. Advantageously, the through-hole 221 is formed in the seam 223 of the bag 220, separately from the body 222 of the bag 220.

In the embodiment shown, the dispensing valve 225 is in an opened state forming an opening 243. The dispensing valve 225 may form the opening 243 by having a closed tip, which is possibly formed by the seaming of the bag, and then cut-off, or otherwise removed. The tip may be a portion of the bag 220 or may be a separate piece. The dispensing valve 225 combined with the present subject matter may be a reed valve which as a unit is known in the art (shown in FIG. 11). In other embodiments, the dispensing valve may be a separate piece connected to the bag 220, such as a silicon membrane having slits therein which cover an opening formed in the bag 220. Other dispensing valves may also be used in conjunction with this bag design. Further, different styles of caps may be used in conjunction with the bag design.

In use, the deformable bag 220 hangs inverted from a hooking device which is attached to a surface or wall within a shower or some other environment where shampoo, conditioner, liquid soap, or other personal care fluid is used. The user squeezes the deformable bag 220 which creates a pressure within the bag 220. This pressure forces the fluid contained within the bag 220 to in turn apply pressure against the dispensing valve 225 forcing the dispensing valve 225 to open, thereby allowing the fluid to flow out of the bag and into the user's hand. The bag 220 is not necessarily made of a resilient material. Therefore, when the bag is squeezed to dispense the fluid, the section or sections of the bag 220 do not necessarily substantially return to their previous position or shape.

The section or sections which form the walls of the bag 220 have little, if any, rigidity. Therefore, unlike the more resilient deformable containers which have more rigid walls described in other embodiments, applying enough pressure internally by pushing on one side of the bag while another side of the bag rests against a surface will not necessarily cause the dispensing valve to dispense the fluid. When the bag is in a deformed state, the pushing of one side of the bag will only cause the fluid within the bag to disperse to an area of least resistance which is not necessarily the dispensing valve opening, but could be other areas within the body 222 of the bag 220 where the walls of the bag provide less resistance. Therefore, unlike other embodiments, the use of the bag 220 necessitates the user to squeeze the bag 220 in some situations to disperse the fluid contained inside.

It will be appreciated by those skilled in the art that various modifications and variations can be made in the present subject matter without departing from the scope of the subject matter. It is intended that the present subject matter include such modifications and variations as come within the scope of the appended claims and their equivalents.

What is claimed:

1. A disposable dispensing system for distributing a fluid for use in a shower, said dispensing system comprising:

a hooking device that is attachable to a surface in a shower which is exposable to moist conditions;

a hook integral to said removable hooking device, said hook extending from said hooking device in a side thereof opposite such surface when said hooking device is attached to such surface;

a deformable container for containing said fluid, said container having an upper portion and a lower portion, said upper portion defining a through-hole therethrough and said lower portion forming a container mouth through which said fluid is flowable, said container having a front side that faces away from the surface of a shower and a back side that faces toward the surface of a shower, said backside being more planar than said front side;

a dispensing valve disposed over said mouth of said container, said dispensing valve controlling the flow of said fluid; and, said container being positionable on said hooking device with said hook extending through said through-hole formed by said upper portion of said container so that said container hangs down from said hooking device, wherein a side of said container defines a first contact area that is spaced from a shoulder of said container during non-dispensing of said fluid and that extends in the direction from said lower portion to said upper portion of said container and is configured for contacting the surface, and wherein said container is resilient so as to substantially resume the same shape possessed prior to the application of a dispensing force once the dispensing force is removed.

2. A disposable dispensing system as in claim 1, wherein said dispensing valve comprises a cap.

3. A disposable dispensing system as in claim 2, wherein said cap is a disk closure cap.

4. A disposable dispensing system as in claim 1, wherein said dispensing valve comprises one of a diaphragm membrane and a reed valve.

5. A disposable dispensing system as in claim 1, further comprising a cap operably disposed over said mouth of said container, said cap defining an aperture that is operably alignable with said dispensing valve and said mouth of said container for dispensilg said fluid.

6. A disposable dispensing system as in claim 5, wherein said dispensing valve is disposed within said cap.

7. A disposable dispensing system as in claim 1, wherein said container rests against the surface in a shower to form a first contact area thereat, thereby allowing a user to apply pressure to one side of said container to cause said dispensing valve to dispense said fluid.

8. A disposable dispensing system as in claim 7, wherein said first contact area between said container and the surface in a shower and a second contact area defined by contact between said container and said hooking device provide stabilizing points for said dispensing system.

9. A disposable dispensing system as in claim 8, wherein said hooking device defines an outer perimeter thereof, and has an elevated skirt on said outer perimeter of said hooking device, said container resting against said skirt proximal to said through-hole of said container when hanging, thereby forming said second contact area between said container and said hooking device.

10. A disposable dispensing system as in claim 7, further comprising an indicator that shows where force should be applied to dispense said fluid from said container.

11. A disposable dispensing system as in claim 7, wherein said first contact area minimizes a folding of said container when pressure is applied.

12. A disposable dispensing system as in claim 7, wherein said container rests against the surface in a shower to form multiple contact areas thereat.

13. A disposable dispensing system as in claim 1, wherein said hooking device is a removable suction cup device.

14. A disposable dispensing system as in claim 13, wherein said suction cup device comprises a lever action suction cup with the lever thereof formed by said hook.

15. A disposable inverted dispensing system for distributing a fluid for use in a shower, said dispensing system comprising:

a removable hooking device that is attachable to a surface that is exposable to moist conditions;

a hook integral to said removable hooking device, said hook extending from said hooking device in a side thereof opposite such surface when said hooking device is attach to such surface;

a deformable container for containing said fluid, said container having an upper portion and a lower portion, said upper portion defining a through-hole therethrough and said lower portion forming a container mouth through which said fluid is flowable, a cap disposed over said mouth of said container, said cap defining an aperture that is operably alignable with said mouth of said container; and, said container being positionable on said hooking device with said hook extending through said through-hole formed by said upper portion of said container so that said container hangs down from said hooking device, wherein said aperture formed by said cap is coverable by a lid, wherein said lid is integral with said cap, and wherein said lid is attachable to said cap when said cap is in an opened position.

16. A disposable dispensing system as in claim 15, wherein said first contact area of said container rests against such surface thereby allowing a user to apply pressure to one side of said container to cause said dispensing valve to dispense said fluid.

17. A disposable dispensing system as in claim 16, wherein a second contact area is formed between said container and said hooking device, and wherein said first contact area and said second contact area provide stabilizing points for said dispensing system.

18. A disposable dispensing system as in claim 17, wherein said hooking device has an elevated skirt on an outer perimeter of said hooking device, said container resting against said skirt proximal to said through-hole of said container while hanging, thereby forming said second contact area between said container and said hooking device.

19. A disposable dispensing system as in claim 16, wherein said first contact area minimizes a folding of said container when pressure is applied.

20. A disposable dispensing system as in claim 16, further comprising an indicator that shows where force should be applied to dispense said fluid from said container.

21. A disposable dispensing system as in claim 16, wherein said container rests against the surface in a shower to form multiple contact areas thereat.

22. A disposable dispensing system as in claim 15, wherein said aperture of said cap is coverable by a dispensing valve that opens upon application of sufficient pressure.

23. A disposable dispensing system as in claim 15, wherein said cap is a dispensing valve.

24. A disposable dispensing system as in claim 15, wherein said hooking device is a suction cup device.

25. A disposable dispensing system as in claim 24, wherein said suction cup device comprises a lever action suction cup with the lever thereof formed by said hook.

26. A disposable dispensing system as in claim 15, wherein said container has a front side that faces away from the shower surface and a back side that faces towards such shower surface, and wherein said back side is more planar than said front side.

27. A disposable inverted dispensing system for distributing a fluid for use attached to a surface in a shower, said dispensing system comprising:

a removable hooking device that is attachable to such shower surface;

a hook integral to said removable hooking device, said hook extending from said hooking device in a side opposite such shower surface when said hooking device is attached to such shower surface;

a resilient deformable container for containing said fluid, said container having an upper portion and a lower portion, said upper portion defining a through-hole therethrough and said lower portion forming a container mouth through which said fluid is flowable;

a cap operably disposed over said mouth of said container, said cap defining an aperture that is operably alignable with said mouth of said container;

a dispensing valve that controls the flow of said fluid out of said container;

a lid configured to cover said dispensing valve, wherein the side of said container defines an indention capable of receiving a portion of said lid; and said container being positionable on said hooking device with said hook extending through said through-hole formed by said upper portion of said container so that said container hangs down from said hooking device and said container rests against such shower surface to form a first contact area, thereby allowing a user to apply pressure to one side of said container to cause said dispensing valve to dispense said fluid.

28. A dispensing system as in claim 27, wherein said lid is integral with said cap.

29. A disposable dispensing system as in claim 28, wherein said lid is attachable to said cap when said cap is in an opened position.

30. A dispensing system as in claim 27, wherein said hooking device is a suction cup device.

31. A disposable dispensing system as in claim 30, wherein said suction cup device comprises a lever action suction cup with the lever thereof formed by said hook.

32. A disposable dispensing system as in claim 27, wherein said container has a front side that faces away from such shower surface and a back side that faces toward such shower surface, and wherein said back side being more planar than said front side.

33. A disposable dispensing system as in claim 27, wherein said first contact area between said container and the shower surface and a second contact area formed between said container and said hooking device provide stabilizing points for said dispensing system.

34. A disposable dispensing system as in claim 33, wherein said hooking device has an elevated skirt on an outer perimeter of said hooking device, said container resting against said skirt proximal to said through-hole of said container when hanging, thereby forming said second contact area between said container and said hiking device.

35. A disposable dispensing system as in claim 27, further comprising an indicator that shows where force should be applied to dispense said fluid from said container.

36. A disposable dispensing system as in claim 27, wherein said first contact area minimizes a folding of said container when pressure is applied.

37. A disposable dispensing system as in claim 27, wherein said container rests against the surface in a shower to form multiple contact areas thereat.

38. A dispensing system comprising:

a hooking device that is attachable to a surface;

a hook integral to said removable hooking device, said hook extending from said hooking device in a side thereof opposite such surface when said hooking device is attached to such surface;

a deformable container for containing said fluid, said container having an upper portion and a lower portion, said upper portion defining a through-hole therethrough and said lower portion forming a container mouth through which said fluid is flowable, said container having a front side that faces away from the surface of a shower and a back side that faces toward the surface of a shower, said backside being more planar than said front side;

a dispensing valve disposed over said mouth of said container, said dispensing valve controlling the flow of said fluid; and, said container being positionable on said hooking device with said hook extending through said through-hole formed by said upper portion of said container so that said container hangs down from said hooking device, wherein a side of said container defines a first contact area that is configured for contacting the surface, and wherein said container is resilient so as to substantially resume the same shape possessed prior to the application of a dispensing force once the dispensing force is removed.

39. A dispensing system as in claim 38, further comprising a cap disposed over said mouth of said container, said cap defining an aperture that is operably alignable with said mouth of said container, and wherein said aperture formed by said cap is coverable by a lid integral with said cap, and wherein said lid is attachable to said cap when said cap is in an opened position.

* * * * *

UNITED STATES PATENT AND TRADEMARK OFFICE

CERTIFICATE OF CORRECTION

PATENT NO. : 7,261,221 B2
APPLICATION NO. : 10/742606
DATED : August 28, 2007
INVENTOR(S) : Jerry R. Awbrey and Michael D. Brown It is certified that error appears in the above-identified patent and that said Letters Patent is hereby corrected as shown below:

Delete the drawing sheet 1 containing figs. 1-4 and replace with the attached sheets containing figs. 1-4.

Figures 1, 2, 3, and 4 in the patent as published are replaced by Figures 1, 2, 3, 3A, 3B, and 4 as attached hereto.

Signed and Sealed this

Twenty-second Day of January, 2008

JON W. DUDAS
*Director of the United States Patent and Trademark Office*

UNITED STATES PATENT AND TRADEMARK OFFICE

CERTIFICATE OF CORRECTION

PATENT NO. : 7,261,221 B2
APPLICATION NO. :10/742606
DATED : August 28, 2007
INVENTOR(S) : Jerry R. Awbrey and Michael D. Brown It is certified that error appears in the above-identified patent and that said Letters Patent is hereby corrected as shown below:

Delete the title page and substitute therefor the attached title page.

Delete the drawing sheets 1-8 and substitute therefor the attached Drawing Sheets 1-11.

This certificate supersedes the Certificate of Correction issued January 22, 2008.

Signed and Sealed this

Nineteenth Day of February, 2008

JON W. DUDAS
*Director of the United States Patent and Trademark Office*

(12) United States Patent
Awbrey et al.

(10) Patent No.: US 7,261,221 B2
(45) Date of Patent: Aug. 28, 2007

(54) INVERTED DISPENSING SYSTEM AND APPARATUS

(75) Inventors: Jerry R. Awbrey, Winder, GA (US); Michael D. Brown, Bethlehem, GA (US)

(73) Assignee: Innovation and Design, Inc., Bethlehem, GA (US)

( * ) Notice: Subject to any disclaimer, the term of this patent is extended or adjusted under 35 U.S.C. 154(b) by 130 days.

(21) Appl. No.: 10/742,606

(22) Filed: Dec. 19, 2003

(65) Prior Publication Data

US 2004/0206776 A1 Oct. 21, 2004

Related U.S. Application Data

(60) Provisional application No. 60/463,628, filed on Apr. 16, 2003.

(51) Int. Cl.
*B67D 5/06* (2006.01)

(52) U.S. Cl. ..... 222/181.3; 222/215

(58) Field of Classification Search ..... 222/105, 222/107, 212, 215, 490, 494, 556, 180, 181.2, 222/181.3; 206/806; 215/395, 399; 220/481–483, 220/751; 248/690, 692

See application file for complete search history.

(56) References Cited

U.S. PATENT DOCUMENTS

| | | | | | |
|---|---|---|---|---|---|
| 3,078,016 | A | * | 2/1963 | Judy | 222/181.2 |
| 3,078,017 | A | * | 2/1963 | Waskonig et al. | 222/181.3 |
| 3,623,641 | A | * | 11/1971 | Hansen et al. | 222/181.3 |
| 4,085,867 | A | * | 4/1978 | Heller | 222/181.3 |
| 4,163,509 | A | * | 8/1979 | Anneus | 222/95 |
| 4,166,553 | A | * | 9/1979 | Fraterrigo | 222/181.2 |
| 4,203,567 | A | * | 5/1980 | Featherstone | 248/108 |
| 4,412,624 | A | | 11/1983 | Tamaka | |
| 4,470,521 | A | * | 9/1984 | Scammell | 222/107 |
| 4,723,671 | A | | 2/1988 | Mears | |
| 4,728,006 | A | | 3/1988 | Drobish et al. | |
| 4,763,382 | A | | 8/1988 | Sumerau | |
| 4,793,517 | A | | 12/1988 | Washut | |
| 4,905,873 | A | * | 3/1990 | Loessl et al. | 222/181.2 |
| 4,969,580 | A | | 11/1990 | Mikhail | |

(Continued)

OTHER PUBLICATIONS

Product Information Sheet—Coppertone Suncare Products, Spectra 3 http://www.coppertone.com/spectra3.aspx.

(Continued)

*Primary Examiner*—Philippe Derakshani
(74) *Attorney, Agent, or Firm*—J. Bennett Mullinax, LLC

(57) ABSTRACT

A disposable inverted dispensing system for distributing a fluid for use in a shower is disclosed. The dispensing system includes a removable hooking device that is attachable to a surface which is exposable to moist conditions. A hook integral to the removable hooking device extends from the hooking device on a side opposite the surface when the hooking device is attached to the surface. A deformable container for containing the fluid has an upper portion and a lower portion. The upper portion defines a through-hole through the container, and the lower portion forms a container mouth through which the fluid is flowable. A dispensing valve and/or a cap is disposed over the mouth of the container for controlling the flow of the fluid. The container is positionable on the hooking device with the hook extending through the through-hole formed by the upper portion of the container so that the container hangs down from the hooking device.

39 Claims, 11 Drawing Sheets

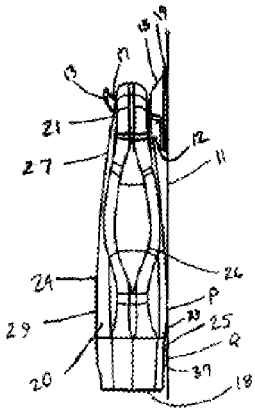

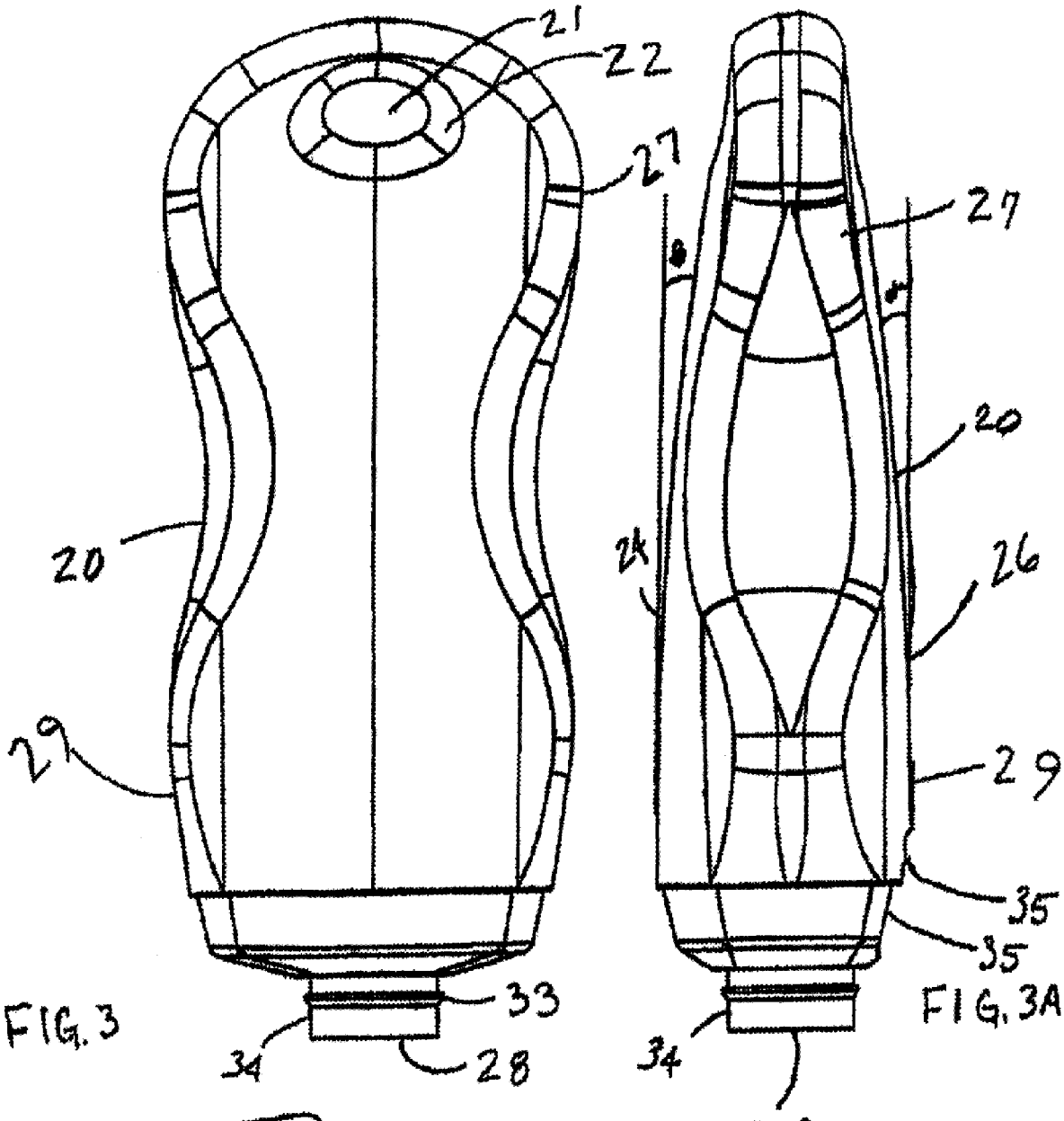
FIG. 3
FIG. 3A
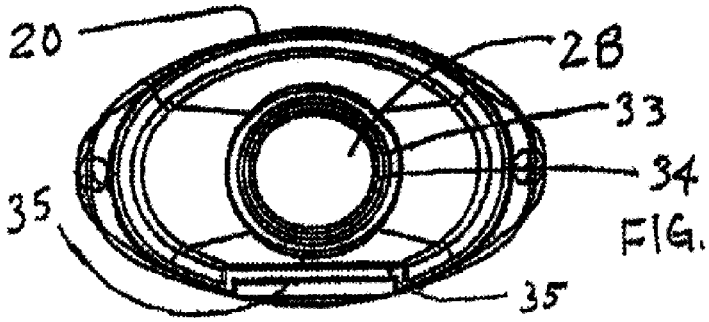
FIG. 3B

F
20
24
25
L
13
17
15
12
11
26
P